US012024886B1

(12) United States Patent
Johnson

(10) Patent No.: US 12,024,886 B1
(45) Date of Patent: Jul. 2, 2024

(54) APPARATUS TO INSTALL VERTICAL REBAR IN FOOTINGS

(71) Applicant: Michael Stewart Johnson, Everett, WA (US)

(72) Inventor: Michael Stewart Johnson, Everett, WA (US)

( * ) Notice: Subject to any disclaimer, the term of this patent is extended or adjusted under 35 U.S.C. 154(b) by 0 days.

(21) Appl. No.: 18/238,412

(22) Filed: Aug. 25, 2023

Related U.S. Application Data

(60) Provisional application No. 63/417,421, filed on Oct. 19, 2022, provisional application No. 63/401,002, filed on Aug. 25, 2022.

(51) Int. Cl.
*E04C 5/16* (2006.01)
*E04G 17/12* (2006.01)

(52) U.S. Cl.
CPC ..... *E04C 5/167* (2013.01); *E04C 5/168* (2013.01); *E04G 17/12* (2013.01)

(58) Field of Classification Search
CPC ..... E04C 5/167; E04C 5/168
See application file for complete search history.

(56) References Cited

U.S. PATENT DOCUMENTS 2,549,459 A 4/1951 Guest
4,110,951 A * 9/1978 Padrun ..... E04C 5/168 403/395
4,132,045 A 1/1979 Sullivan
5,216,866 A * 6/1993 Ekedal ..... E04C 5/168 52/684
5,371,991 A * 12/1994 Bechtel ..... E04C 5/20 24/339
5,626,436 A * 5/1997 Dragone ..... E04C 5/167 24/339
7,559,532 B1 * 7/2009 Kodi ..... E04C 5/20 52/DIG. 1
7,900,419 B2 * 3/2011 Kodi ..... E04C 5/20 52/719
7,908,723 B1 3/2011 Kodi
8,117,796 B2 * 2/2012 Kodi ..... E04C 5/163 52/719
8,231,100 B2 * 7/2012 Boese ..... E04G 17/12 249/34

(Continued)

*Primary Examiner* — Adriana Figueroa
(74) *Attorney, Agent, or Firm* — John Rizvi; John Rizvi, P.A.—The Patent Professor®

(57) ABSTRACT

An apparatus or assembly for use in a construction environment comprises an angled stabilization bracket and at least one clip removably mounted to the stabilization bracket. The angled stabilization bracket comprises a top portion having a first longitudinal edge and a second longitudinal edge opposing the first longitudinal edge, and a first side portion angularly extending from the first longitudinal edge; and a clip-receiving slot defined in the first side portion of the angled stabilization bracket. The at least one clip is slidably and removably disposed in the clip-receiving slot. The at least one clip further comprising at least one rebar-receivable and rebar-guiding passageway. The at least one clip is configured to receive and retain at least one rebar. The angled stabilization bracket is configured for attachment to a structure. The assembly is configured for use to ensure accurate placement or registration of vertical rebar in a construction environment.

15 Claims, 22 Drawing Sheets

(56) References Cited

U.S. PATENT DOCUMENTS

| | | | | |
|---|---|---|---|---|
| 9,267,288 | B2 | 2/2016 | Kodi | |
| 9,816,273 | B2 | 11/2017 | Yi | |
| 10,125,468 | B2 * | 11/2018 | Henriquez | E04G 9/05 |
| 10,519,660 | B2 | 12/2019 | Evans | |
| 11,293,192 | B2 * | 4/2022 | Vitale, Jr. | E04C 5/205 |
| 11,319,707 | B1 * | 5/2022 | Ayres | E04C 5/167 |
| 2013/0180200 | A1 | 7/2013 | Gavin | |
| 2014/0215955 | A1 | 8/2014 | Coleman | |

* cited by examiner

APPARATUS TO INSTALL VERTICAL REBAR IN FOOTINGS

CROSS-REFERENCE TO RELATED APPLICATIONS

This application claims the benefit of U.S. Provisional Patent Application No. 63/401,002, filed on Aug. 25, 2022, and U.S. Provisional Patent Application No. 63/417,421 filed on Oct. 19, 2022, which are incorporated by reference herein in their entireties.

FIELD OF THE INVENTION

The present invention relates generally to construction articles and methods, and more particularly, to an apparatus and method for installing and securing vertical rebar in footings.

BACKGROUND OF THE INVENTION

The construction of homes, dwellings, and other building structures requires careful attention to the foundation. An essential part of the foundation construction is the footing. The footing, as part of the foundation, functions as a base to the overlying floor columns and floor walls, for example. The footing creates an attachment point between the foundation and the soil. In particular, the footing is that lowermost part of the foundation that is in contact with the earth, helping to transfer the vertical loads directly to the soil. The footing helps support a building to prevent settling.

One conventional approach to building a footing first involves an excavation project to remove the portion of earth where the footing will be built. This project produces a footing trench that traces the periphery of the structure to be built. A foundation formwork is then assembled in the trench to create the mold for the footing. Fresh concrete is later poured into the trench or footing space shaped by the framework, which results in the formation of the footing structure once the concrete hardens and cures. Formwork is typically a temporary structure that is removed once the poured concrete hardens. A typical concrete form uses plywood, particle board, or other thin, sheet-like pieces of wood or timber as the framing material for lining the sides of the trench to form the sidewalls of the footing space. The upper level of the formwork defines the topmost surface of the concrete footing once it is poured. The concrete would be poured, for example, to the top level of the sidewalls. After the concrete hardens and cures, the framework is disassembled and removed, leaving a self-standing and self-supporting concrete footing.

Once the footing space is created by the form, and prior to the pouring of the concrete, a network or web of rebar is located in the footing space as reinforcement for the concrete. Several lines of spaced-apart horizontal rebar are placed at a lower end of the footing space. The horizontal rebar runs the entire course of the footing trench, including the corners. Additionally, a series of vertical rebar pieces is typically coupled to the horizontal rebar at certain fixed intervals or locations along the route of the horizontal rebar. The horizontal rebar will be completely encased in the poured concrete. In some engineering designs, though, the vertical rebar is partially encased in the concrete footing and partially extends above it. The vertical rebar, for example, typically extends beyond the upper level of the footing since it functions as a transition reinforcement from foundation to walls. For example, in a block foundation wall including several courses of cinder blocks stacked on the concrete footing, the vertical rebar will pass through the voids or cells in the cylinder block of at least one if not more of the horizontal courses. The cells are then filled with grout to facilitate bonding with the rebar.

The placement of vertical rebar is specified by various sources and authorities, including building code regulations, best practices, and the engineering plans for the structure. The accuracy of the vertical rebar placement is absolute and critical. Various methods are used to mark the vertical rebar locations. For example, a template such as a long 2"×4" board spans the length of the trench and is seated at the height of the footing space. A workman moves along the trench and places marks on the template at the various locations where vertical rebar pieces should be installed. The vertical rebar typically has a J-hook at its lower end that fits cross-wise under the horizontal rebar to form a joint or intersection requiring coupling. The accurate and precise positioning of the vertical rebar is just one factor to consider in the rebar layout. Another equally important consideration is ensuring that the vertical rebar maintains its proper vertical alignment. Not only is it important to lay the vertical rebar so that it is vertically aligned, but attention must be given to ensure that the vertical rebar keeps this alignment and does not shift during concrete pouring in the footing trench space.

Various problems, challenges and limitations are encountered during the installation of vertical rebar. The vertical rebar and horizontal rebar need to be coupled together at their intersection or crossing point. This coupling is typically performed with a linear stretch of metal wire to tie the rebar pieces together. While low-cost, this option is labor-intensive, cumbersome, and time-consuming. The wire has to be bent, maneuvered, and wound around the pieces to form a tie-down or wired knot secure enough to fasten the pieces together and prevent relative movement, while ensuring that the vertical positioning and alignment of the vertical rebar is not disturbed during the knotting process. A workman, for example, has to bend down into the trench at every rebar intersection and manually tie down the crossing rebars, wrapping the wire around the rebar pieces in a series of overlapping loops or circuits to ensure that the rebar pieces are tightly and firmly fastened together to eliminate relative movement between them. As a strictly manual task, the formation of a wired tie-down, involving a sequence of windings wrapped around the rebar pieces, makes it difficult to reproduce each tie-down in the exact identical manner, potentially creating variations in how well the rebar intersections are secured.

A more challenging consideration is the alignment of the vertical rebars. In one approach, a 2"×4" piece of wood is disposed transversely across the footing trench, spanning the opposite sides of the concrete form that borders the excavated footing trench. The piece of wood is situated horizontally and rests on the opposite sides of the concrete form sidewalls. These temporary wood pieces are situated at the locations where vertical rebar is marked for installation. A hole is drilled through the wood piece at the precise spot where vertical rebar should be located. Careful effort is made to ensure that the hole is oriented vertically, though this manual procedure can be inexact. The workman then threads or inserts the vertical rebar through the drilled hole, advancing the rebar far enough until it is appropriately positioned relative to the horizontal rebar or complies with some other installation guideline or specification. This approach has the benefit of simplicity and ease of use, but is prone to errors and inaccuracies. The use of a hole drilled through malleable wood offers the possibility that the vertical rebar can move and shift around while threaded through the hole, in response to lateral disturbances such as the turbulent flow of concrete as the footing is filled. Additionally, as the concrete settles, this process may evidence imperceptible laminar flow that can also disturb the stable positioning of the vertical rebar. Moreover, any alignment error in making the rebar-insertion hole will cause a corresponding misalignment in the vertical rebar once it is threaded through the hole. Even inadvertent user error can move the inserted vertical rebar out of alignment. For example, after the rebar is placed through the hole, any contact, collision, or impact with the inserted rebar, even slight, can shift the rebar from its proper orientation, due to the malleability and pliability of the wood. Such contact can occur inadvertently as workmen move about the construction site carrying materials and other loads.

Accordingly, there exists a need for a solution to at least one of the aforementioned problems. For instance, there is an established need for an alignment tool or mechanism to facilitate accurate placement and alignment of vertical rebar in a footing application. Additionally, there is an established need for a one-piece mechanism to provide a stable, secure holding force on vertical rebar and which can also be used to fasten crisscrossing vertical and horizontal rebar pieces at their intersection point.

SUMMARY OF THE INVENTION

The present invention is directed to an assembly configured to facilitate the accurate and precise alignment and installation of vertical rebar in a construction or building environment, such as a foundation or footing application. The assembly includes, in combination, a bracket configured to temporarily anchor to a rebar-locating support structure, and a rebar-receiving and securing clip removably mounted to the bracket.

The bracket has an angled configuration including a top side and a front clip-mounting side that extends orthogonally downward from the front edge of the top.

In one aspect, the bracket, for example, can attach to a piece of wood that makes up part of the formwork for a footing, or a piece of wood adapted to attach to the formwork. Various fastener holes are formed in the bracket to allow the bracket to be temporarily fastened to the support structure using nails or screws. The bracket top is equipped with spikes projecting from its lower surface in facing opposition to the support structure. The spikes penetrate the temporary support structure during deployment, providing a means to stably anchor the bracket. The top side includes a downturned lip portion at its rear edge. The downturned lip portion is disposed in spaced-apart, facing opposition to the front side of the bracket to define an open, double-sided channel or inverted U-shaped seat between them. The front clip-mounting side and the rear downturned lip portion both define dependent features of the bracket, extending downward from opposite longitudinal edges of the top side. During deployment, the open U-shaped channel of the bracket fits over and is seated on the temporary support structure, with the top side facing the mounting surface of the temporary support structure. The bracket is sized, shaped, and dimensioned so that in this seating arrangement, the dependent features of the bracket—the front clip-mounting side and the rear downturned lip portion—sandwich the temporary support structure in a tight, intimate relationship promoting stability and inhibiting relative lateral movement.

The clip has a generally rectangular, planar configuration including an upper side, a lower side, a right side, and a left side. The sides define a void or empty interior space. Each side has a slotted, split-design construction incorporating a keyhole-shaped slot that extends from a front edge of each side. The clip has a symmetrical design, so that the keyhole-shaped slots formed in the upper side and the lower side are mirror images of one another, while the keyhole-shaped slots formed in the right side and the left side are mirror images of another. Each keyhole-shaped slot has an elongate, slit-shaped proximal section and a curved, generally circular distal section. The clips are slidably mounted and received within a recess or groove formed in the front side of the bracket. In their mounting position, the keyhole-shaped slots formed in the upper side and the lower side are mutually oriented so that their respective circular-shaped distal sections define a vertical dimension aligning with a desired vertical direction for installing rebar. The symmetry of the clip renders the clip equally functional and identical in structure regardless of which end is up (upper side or lower side), making the clip a reversible rebar-holding tool. During installation, the vertical rebar is aligned (orthogonally) with the horizontally-extending, slit-shaped proximal sections of the keyhole-shaped slots of the upper side and the lower side of the clip. The vertical rebar is advanced through the slit-shaped proximal sections at the upper and lower sides of the clip until the rebar terminates in the circular distal sections, snapping into place. The clip is flexible or pliable, allowing the right and left sides of the clip to deflect, deform or spread apart as the rebar piece moves through the comparatively narrower slit (i.e., the width of the slit is smaller than the diameter of the interposing rebar piece). Once the advancing rebar reaches the end of the keyhole-shaped slot (i.e., the open circle, terminal distal section), the rebar snaps into place and the clip closes around the rebar in a compression-type hold, in which the right and left sides return to their relaxed, undeflected state and the narrow slit is restored. The clip has an additional use beyond alignment of the vertical rebar. The clip can also be used to couple together a vertical rebar and a horizontal rebar at their crossing point. The vertical rebar would be mounted to the clip in the same fashion as above, while the horizontal rebar would be located in the keyhole-shaped slots formed in the right and left sides of the clip. In this double-rebar coupling application of the clip, there is no need for the bracket; only the clip is used to form the coupling.

In a first implementation of the invention, an apparatus or assembly for use in a construction environment is provided. The assembly comprises an angled stabilization bracket including a top portion having first and second opposing longitudinal edges, and a first side portion angularly extending from the first edge of the top portion. The assembly further includes a clip-receiving slot defined in the first side portion of the angled stabilization bracket, and one or more clips that are slidably and removably disposed in the slot. Each clip further defines a first rebar-receivable and rebar-guiding passageway extending in a first direction, and a second rebar-receivable and rebar-guiding passageway extending in a second direction. The relative orientation of the first direction and the second direction defines one of an orthogonal and skew relationship.

In a second aspect, the angled stabilization bracket can include a second side portion extending from the second edge of the top portion. The second side portion, in one form, can define one of a downturned lip, a downturned edge, a depending feature, a flange member, an extension, and a projection.

In another aspect, the first side portion and the second side portion of the angled stabilization bracket may cooperate to define a longitudinally-extending channel therebetween. The channel may be sized, shaped and dimensioned to receive a structure to which the angled stabilization bracket is temporarily mounted during use. The temporary structure can be a footing-related construction article.

In another aspect, the top portion of the angled stabilization bracket can include one of an opening and an aperture.

In another aspect, the angled stabilization bracket may define a unitary body. The unitary body may include one or more fastener-receiving apertures. The one or more fastener-receiving apertures can include at least one fastener-receiving aperture formed in the top portion and at least one fastener-receiving aperture formed in the slot.

In another aspect, the slot can define a recessed feature formed in the first side portion of the angled stabilization bracket.

In another aspect, the first side portion may extend orthogonally from the top portion.

In another aspect, the assembly may further include one or more spikes extending from a lower side of the top portion.

In another aspect, the first direction can define a vertical dimension and the second direction can define a horizontal dimension.

In another aspect, the first side portion may form a plate.

In another aspect, the first longitudinal edge and the second longitudinal edge of the top portion may define a front periphery and a rear periphery, respectively.

In another aspect, each clip can include a body having a base and a pair of symmetrical, spaced-apart and opposing first half section and second half section extending from the base. The first half section and the second half section cooperatively may define an upper side and a lower side of the clip. Each one of the upper side and the lower side can include a slot extending inward from an outer edge, wherein the slot has an elongate proximal section and a curved distal section. The elongate proximal section may define a slit and the curved distal section may define an open circle. The slot, in one form, may have a keyhole-shaped profile.

In another aspect, each clip can include a base and a body coupled to the base. The clip body may include an upper side, a lower side, a right side, and a left side. The clip may further include an upper front edge, a lower front edge, a right front edge, and a left front edge. The clip may further include a keyhole-shaped slot formed in the upper side and extending from the upper front edge, a keyhole-shaped slot formed in the lower side and extending from the lower front edge, a keyhole-shaped slot formed in the right side and extending from the right front edge, and a keyhole-shaped slot formed in the left side and extending from the left front edge. Each keyhole-shaped slot can have an elongate proximal section and a curved distal section.

In another aspect, the curved distal section of the keyhole-shaped slot formed in the upper clip side may cooperate with the curved distal section of the keyhole-shaped slot formed in the lower clip side to define the first rebar-receivable and rebar-guiding passageway. Additionally, the curved distal section of the keyhole-shaped slot formed in the right clip side may cooperate with the curved distal section of the keyhole-shaped slot formed in the left clip side to define the second rebar-receivable and rebar-guiding passageway.

In another aspect, each keyhole-shaped slot can include a proximal slit-forming section and a distal open circle section.

In another aspect, the clip may be formed of a deformable, resilient, flexible material.

In another aspect, the assembly can adopt a deployment configuration in which the angled stabilization bracket is mounted temporarily to a piece of footing formwork by disposing the top portion on an upper surface of the piece of footing formwork so that the first side portion and the second side portion at least partially capture or enclose the piece of footing formwork therebetween and the one or more spikes penetrate into the piece of footing formwork in a temporary anchoring relationship.

In another aspect, the deployment configuration may further include sliding each clip into position in the clip-receiving slot formed in the first side portion of the angled stabilization bracket.

In another aspect, the deployment configuration can facilitate installation of a vertical rebar by locating the rebar in the distal open circle section of the keyhole-shaped slot formed in the clip.

In another aspect, the clip can include a hollow rectangular body having an open front end, an upper and a lower side, and a right and a left side. A first keyhole-shaped slot may be formed in each of the upper and lower sides and which extends from a front peripheral edge of the clip body to a first depth. A second keyhole-shaped slot may be formed in each of the right and left sides and which extends from the front peripheral edge of the clip body to a second depth. The first depth may be greater than the second depth, creating an offset that allows the guide clip to simultaneously hold, in tandem, a vertically-oriented rebar in the pair of first keyhole-shaped slots and a horizontally-oriented rebar in the pair of second keyhole-shaped slots.

In another aspect, the clip can include a hollow rectangular body having an open front end, an upper and a lower side, and a right and a left side. A first keyhole-shaped slot may be formed in each of the upper and lower sides, which first keyhole-shaped slot may extend from a front peripheral edge of the clip body to a first depth. A second keyhole-shaped slot may be formed in each of the right and left sides, which second keyhole-shaped slot may extend from the front peripheral edge of the clip body to a second depth. The first depth may be greater than the second depth, creating an offset that allows the guide clip to simultaneously hold, in tandem, a vertically-oriented rebar in the pair of first keyhole-shaped slots and a horizontally-oriented rebar in the pair of second keyhole-shaped slots.

In a second implementation, the clip may be used on its own to hold a rebar or other construction conduit, pipe or the like.

In a third implementation, an apparatus or assembly for use in a construction environment may comprise an angled stabilization bracket including a top portion and a first side portion. The top portion has a first longitudinal edge and a second longitudinal edge opposing the first longitudinal edge. The first side portion angularly extends from the first longitudinal edge. A clip-receiving slot is defined in the first side portion of the angled stabilization bracket. The assembly further comprises at least one clip slidably and removably disposed in the clip-receiving slot. The at least one clip further comprises at least one rebar-receivable and rebar-guiding passageway extending in a first direction, and a second rebar-receivable and rebar-guiding passageway extending in a second direction and oriented in one of orthogonal and skew to the first direction.

In one aspect, the at least one clip further comprises a third rebar-receivable and rebar-guiding passageway extending in the first direction parallel to the first rebar-receivable and rebar-guiding passageway.

In one aspect, the apparatuses and components can be made of any suitable material capable of an elastic or reversible deformation. This material construction can include, but is not limited to, rubber, plastic, natural polymers, synthetic polymers, and resins.

In one aspect, the apparatuses and the components thereof may be of any suitable size or dimensions as referred to herein.

In one aspect, the apparatuses described herein may be used to install and secure building materials such as rebar.

In a third implementation, the clip may be used independently to install and secure materials.

In one aspect, the clip may be used to install and secure building materials such as, for example without limitation, rebar, water pipe, electrical conduit, or the like.

In one aspect, the clip may be utilized in all phases of construction, as it may retain and stabilize any round, circular or tubular objects, such as, for example without limitation, rebar, plumbing water pipes, electrical EMT conduit, rebar, or any piping with a circular cross section. Nonlimiting examples of water pipes may include pipes made of Copper, PEX, PVC, CPVC, or the like. Nonlimiting examples of electrical conduit may include conduit made of PVC, EMT conduit, or the like. The clip is configured to be used on its own (without the stabilization bracket) in plumbing and electrical applications. The clip may be made in multiple sizes configured to accommodate a rebar, pipe, conduit or the like, sized from between about 1.50" diameter to about 1.25" diameter structures.

In one aspect, the clip may be configured to accommodate a structure with any suitable cross section having any geometric shape (circular, square, hexagonal, or the like).

In one aspect, the clip may be configured to include horizontal and vertical slots which have an inner diameter (ID) that is the same diameter or cross-sectional dimensions as the outer diameter or outside dimension (OD) as the rebar, piping, or other object to be retained therein. For example without limitation, rebar or piping with an OD of ⅝" may be conveniently and securely held in a clip which has horizontal or vertical slots that have an ID of ⅝". As noted herein, the ID of the slots may be slightly smaller than the OD of the object to be secured.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIG. 10CD presents a left side view of the vertical rebar installation bracket illustrated in FIG. 9, the right side view being a mirror image thereof;

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a kit or assembly configured to provide a secure and properly aligned installation of vertical rebar in a variety of construction environments and applications, such as rebar placement in footings for building foundations.

Figure 6:
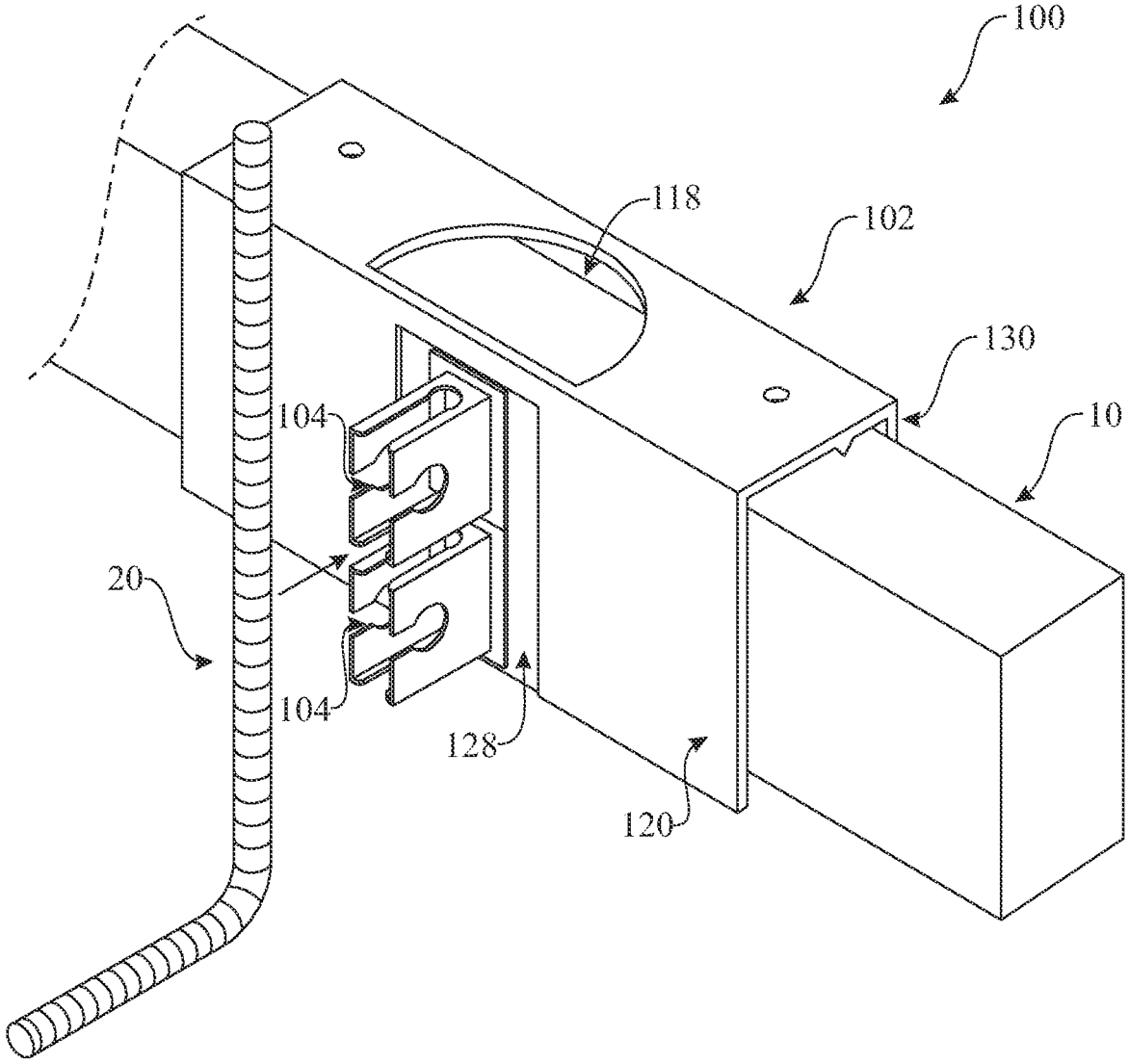
FIG. 6 presents a right side, front, top isometric view of the template-mounted vertical rebar installation bracket illustrated in FIG. 5, further illustrating the alignment of a vertical rebar to the mounted guide clips in advance preparation for installation.
Figure 7:
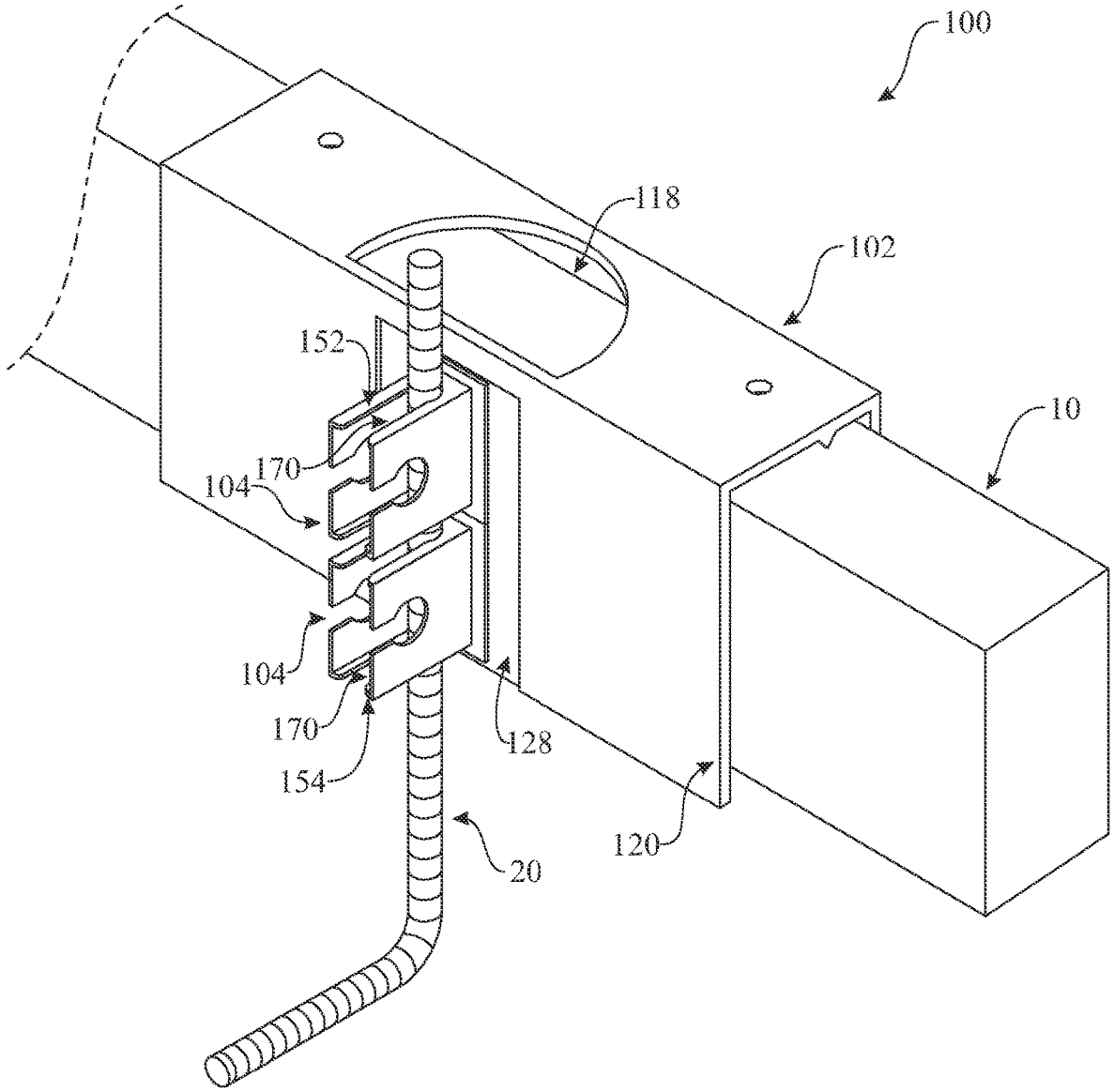
FIG. 7 presents a right side, front, top isometric view of the template-mounted vertical rebar installation bracket illustrated in FIG. 6, further illustrating the installation of the vertical rebar received in the guide channels defined in the mounted guide clips.
Figure 8:
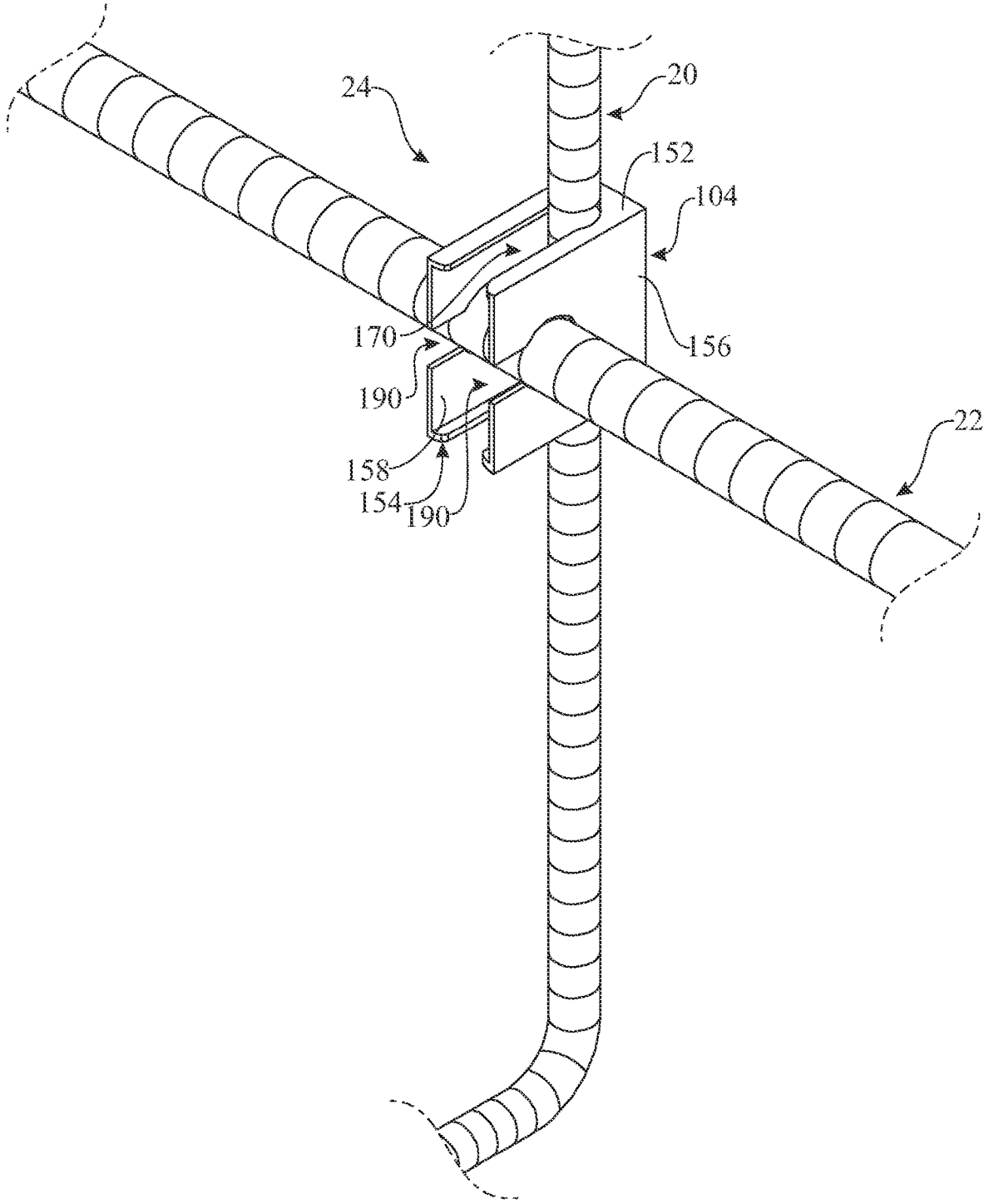
FIG. 8 presents an isometric view of a rebar-alignment and rebar-holding guide clip shown in FIGS. 4-7 and used in an alternative application to secure a crossing pair of vertical and horizontal rebar members at their intersection, according to a second illustrative embodiment of the present invention.

Referring initially to FIGS. 1-8, a rebar installation assembly 100 is illustrated in accordance with a first exemplary embodiment of the present invention is shown at FIGS. 1-7, and a second exemplary embodiment is shown at FIG. 8.

Figure 4:
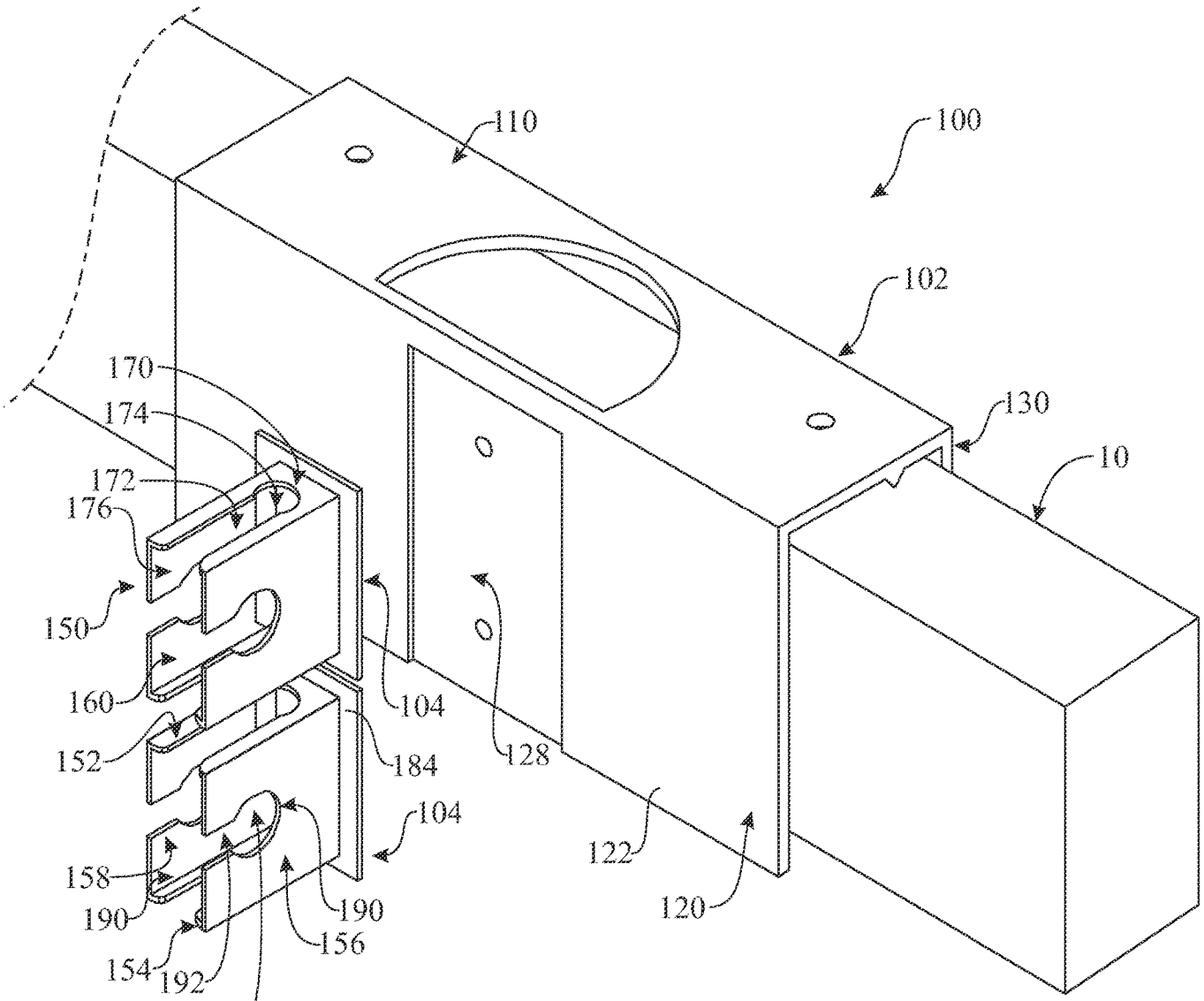
FIG. 4 presents a right side, front, top isometric view of the template-mounted vertical rebar installation bracket illustrated in FIG. 3, more particularly illustrating in disassembled form a set of rebar-alignment and rebar-holding guide clips positioned and set for removable mounting to a clip-receiving slot formed in the rebar installation bracket.

As shown in FIG. 4, the assembly 100 includes, in combination, a rebar installation and stabilization bracket 102 and at least one rebar-alignment and rebar-holding guide clip 104 that is removably mounted to bracket 102. During use, the bracket 102 is temporarily mounted to a conventional piece of timber 10 used in footing applications, such as a template or temporary wood backboard to mark locations for installing vertical rebar. The guide clip 104 is configured in one form as a vertical rebar holder and alignment tool. In particular, the mounted guide clip 104 receives an exemplary rebar 20 through a rebar-receiving slot and securely holds it in a properly aligned, vertical position. The assembly 100 ensures accurate placement or registration of vertical rebar, which is beneficial in construction environments or applications where vertically-arranged rebar is necessary for building a foundation and/or footing. The bracket 102 provides a stable platform to mount guide clip 104, and, in turn, the vertically-oriented rebar 20. The assembly 100 can be manufactured and made available as a kit of discrete components.

Figure 1:
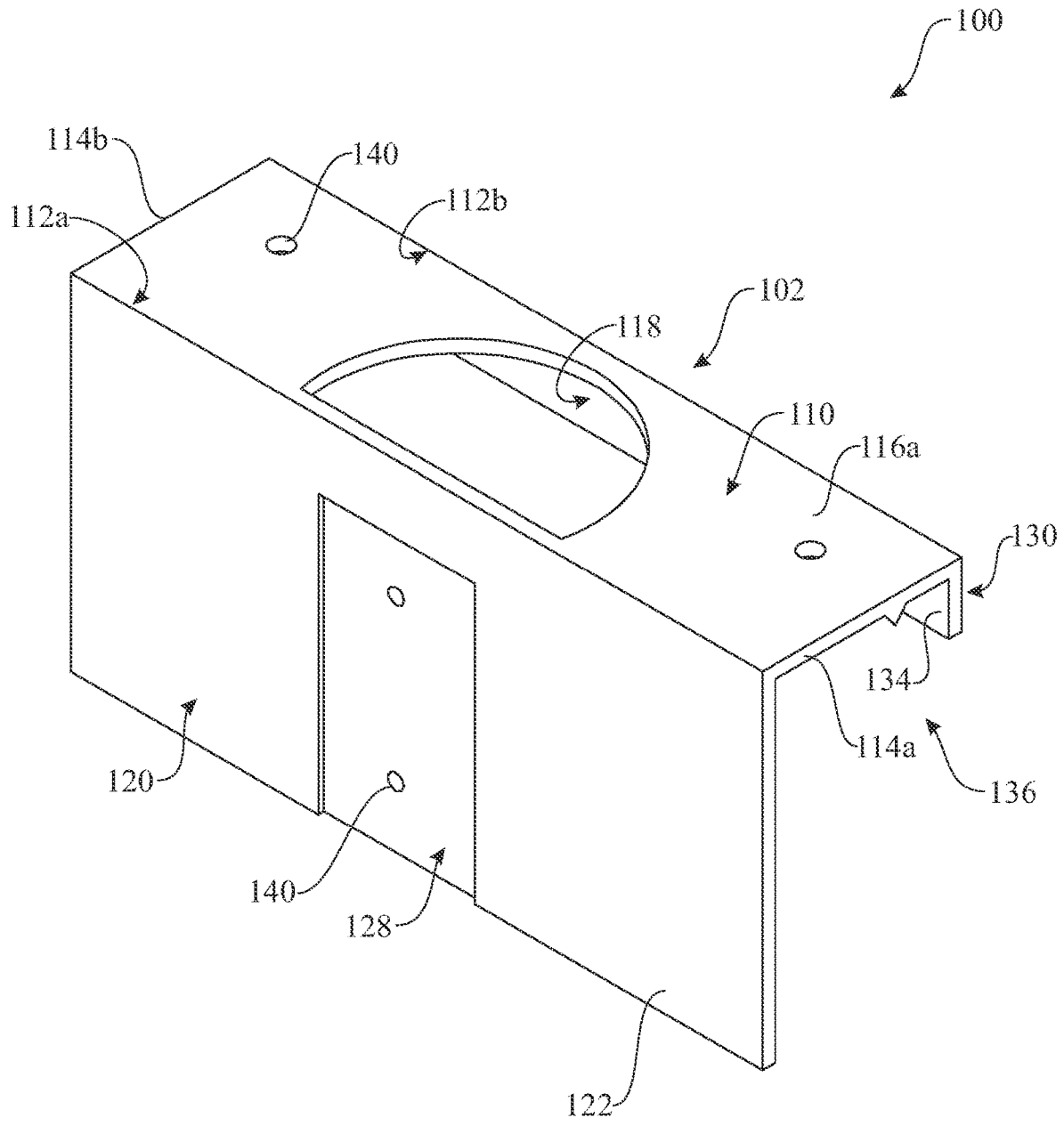
FIG. 1 presents a right side, front, top isometric view of a vertical rebar installation bracket, in accordance with a first illustrative embodiment of the present invention.
Figure 2:
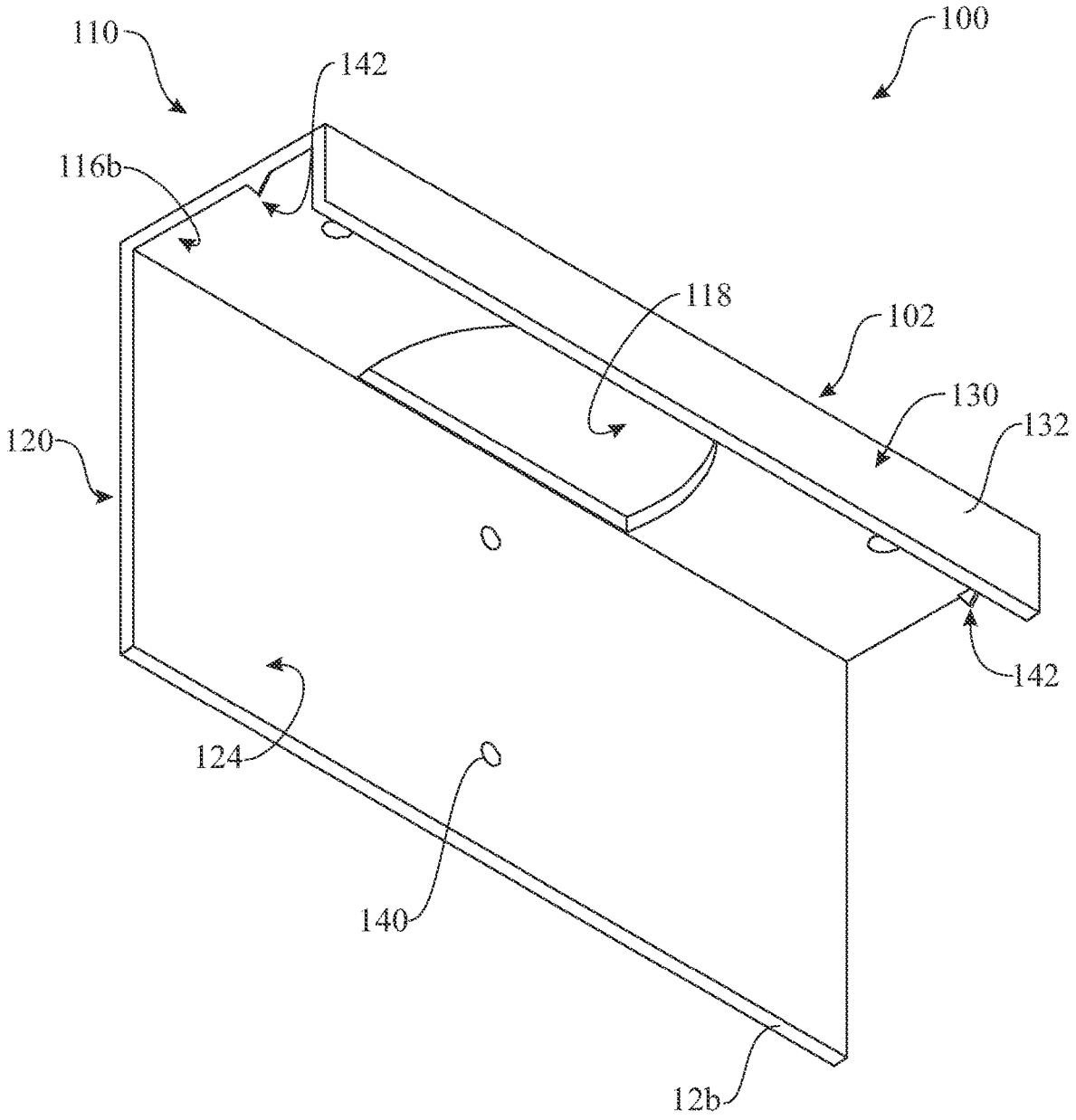
FIG. 2 presents a right side, rear, bottom isometric view of the vertical rebar installation bracket illustrated in FIG. 1.
Figure 3:
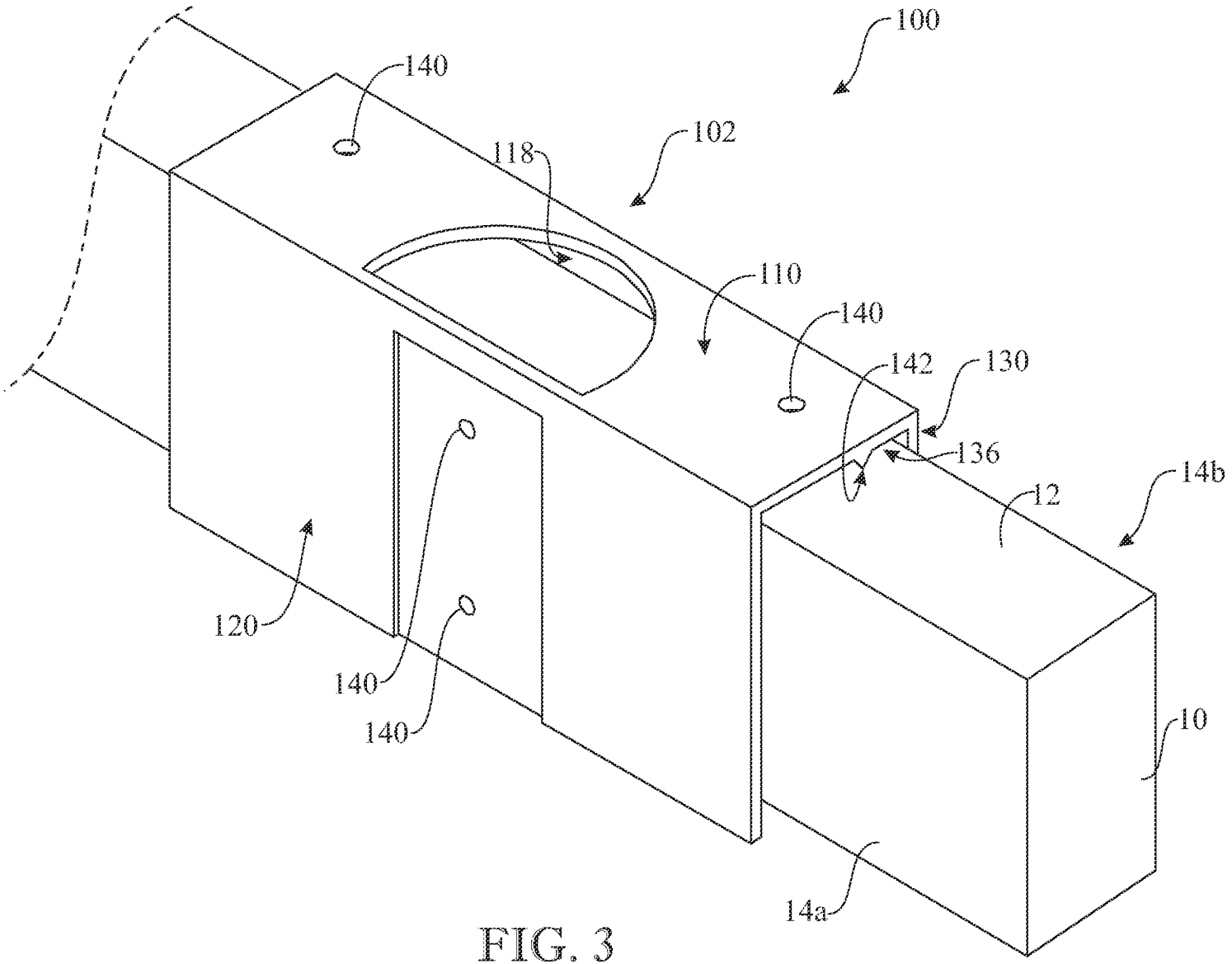
FIG. 3 presents a right side, front, top isometric view of the vertical rebar installation bracket illustrated in FIG. 1, more particularly illustrating an application environment in which the bracket is mounted to a template at a location to install vertical rebar.

Referring more particularly to FIGS. 1-3, the bracket 102 includes, in combination, a top side 110, a front clip-mounting side 120, and a rear downturned lip or edge 130. These features of bracket 102—the front side 120, the rear downturned lip 130, and the intervening top side 110—each has a generally rectangular, planar form. The top side 110 includes front and rear longitudinal edges 112*a,b*, and right and left lateral edges 114*a,b* extending between longitudinal edges 112*a,b*, upper surface 116*a*, and lower surface 116*b*. The front side 120 extends at an angle, preferably orthogonally, from the front longitudinal edge 112*a* of the top side 102, forming an angled arrangement. The front side 120 includes a front or outer surface 122, a rear or inner surface 124, and a bottom edge 126. The rear downturned lip 130 effectively forms a low rear wall or side (compared to front side 120) extending from the rear longitudinal edge 112*b* of the top side 110, preferably in an orthogonal relationship. The front side 120 and the rear lip 130 form dependent features of the bracket 102, disposed in facing opposition to one another. The rear lip 130 includes an outer surface 132, and an inner surface 134 disposed opposite and facing the inner surface 124 of the front side 120. The front side 120 and the rear lip 130 define a template-receiving channel generally illustrated at 136, which forms the space extending between the inner surface 124 of the front side 120 and the opposing inner surface 134 of the rear downturned lip 130. This channel 136 receives the temporary support 10 during deployment of the assembly 100, in which the bracket 102 is mounted to the temporary support 10, as discussed further. The front side 120 can be configured as a plate-like structure.

During use, in reference to FIG. 3, the bracket 102 is deployed in cooperation with the temporary support 10, such as a 2"×4" piece of lumber. As known, the construction of concrete footings requires a form to create the boundary space within which concrete is poured. The temporary support 10, for example, can be a section of this formwork or a lumber piece adapted to fit onto this framework. However implemented, the temporary support 10 facilitates the use of the assembly 100 to properly locate, align, and place a vertical rebar at the required spot (e.g., within the footing space). In one form, for example, the temporary support 10 can span between the sidewalls of the formwork located at opposite sides of the footing trench. The temporary support 10, in this implementation, would extend crosswise or transversally across the footing trench space. Alternately, the temporary support 10 can be part of a footing template running the length-wise course of the footing trench. The temporary support 10 will typically be located at or above the upper surface or top level of the expected concrete pour.

The bracket 102, in one form, has the general shape of a flat or planar, J-shaped, hanging bracket hook, which, during deployment, adopts an inverted configuration. The front side 120 facilitates a secure attachment to a mounted article (i.e., temporary support 10), the rear lip 130 functions as a curb stop or break to constrain lateral movement of the mounted article, and the top side 110 is seated on the mounted article. The temporary support 10, for example, has an upper surface 12 and a pair of side surfaces 14*a,b*. During installation, the bracket 102 is appropriately located and otherwise mounted on the temporary support 10. In this mounting relationship, the top side 110 of the bracket 102 is disposed on the upper surface 12 of the temporary support 10, the front side 120 of the bracket 102 is disposed in facing opposition to the first side surface 14*a* of temporary support 10, and the rear downturned lip 130 of the bracket 102 is disposed in facing opposition to the second side surface 14*b* of the temporary support 10. The temporary support 10, at an upper section, fits within and otherwise occupies the template-receiving channel formed between the front side 120 and the rear downturned lip 130 of the bracket 102. The size, shape and dimensions of the bracket 102 and the temporary support 10 are appropriately coordinated so that the bracket 102 will fit snugly over the temporary support 10. This snug fit preferably minimizes the clearance or gap space between the temporary support 10 (at the sides 14*a,b*) and the front side 120 and the rear downturned lip 130 of the bracket 102, and thereby restrain side-to-side relative movement between the bracket 102 and the temporary support 10.

The bracket 102 incorporates various features to secure the bracket 102 to the temporary support 10. The bracket 102 includes an array of individual fastener-receiving holes 140 distributed at various suitable locations of the bracket 102, features tailored to facilitating the temporary attachment of the bracket 102 to the mounted temporary support 10. Suitable conventional fasteners, such as screws or nails, are threaded through the fastener-receiving holes 140 to penetrate the temporary support 10, securing the bracket 102 to the temporary support 10. Additionally, the bracket 102 is provided with an array of individual anchoring spikes 142 extending or projecting from the lower surface 116*b* of the top side 110. In one form, for example, a set of spikes 142 are located at the right and left lateral edges 114*a,b* of the top side 110. During the mounting or placement of the bracket 102 onto the temporary support 10, as the top side 110 approaches and comes into intimate engagement with the temporary support 10 at its upper surface 12, the spikes 142 carried by the top side 110 penetrate into the wood body of the temporary support 10 and establish an anchoring hold. The combination of the fastener-receiving holes 140 and the anchoring spikes 142 establish fastening features that securely hold together the bracket 102 and the temporary support 100, inhibiting and otherwise resisting relative movement of these components in both the longitudinal (length-wise) and transverse (width-wise) directions. Additionally, the capture of temporary support 10 within the groove or channel 136 formed between front side 120 and the rear downturned lip 130 of the bracket 102 helps control any relative lateral movement between the parts. The bracket 102 maintains a stable mounting relationship to the temporary support 10.

Figure 5:
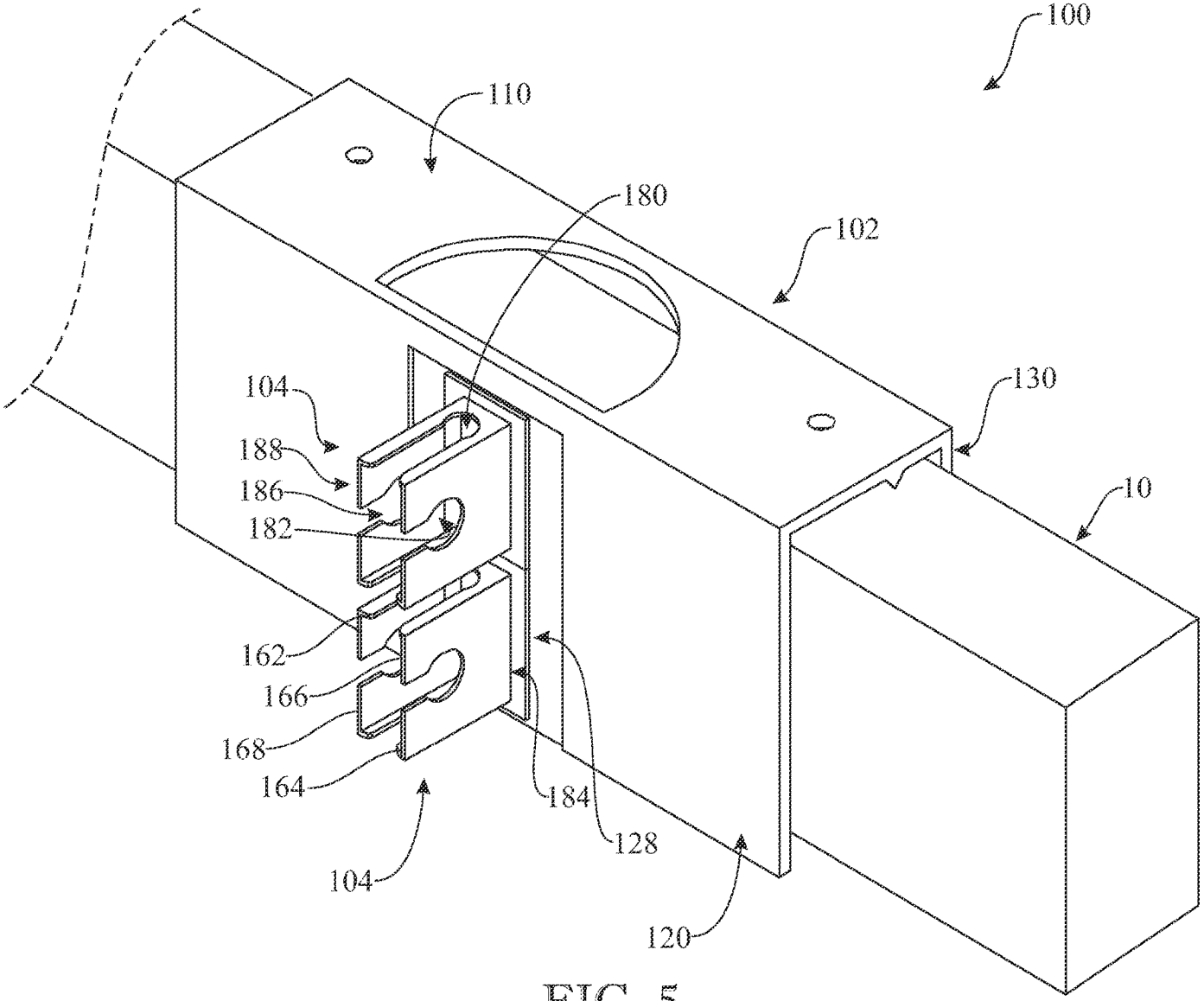
FIG. 5 presents a right side, front, top isometric view of the template-mounted vertical rebar installation bracket illustrated in FIG. 4, further illustrating the mounting of the guide clips to the rebar installation bracket.

Referring now to FIGS. 4-5, with continuing reference to FIGS. 1-3, the guide clip 104 includes a hollow, generally rectangular body 150 having a spaced-apart and oppositely disposed upper side 152 and lower side 154, and a spaced-apart and oppositely disposed right side 156 and left side 158. Each side of the body 150 has a generally planar formation and a rectangular shape. The guide clip body 150 has a front edge periphery 188 defining an open front end generally illustrated at 160, which facilitates the ingress and egress of a piece of rebar entering and exiting guide clip 104, respectively. As discussed further in connection with FIGS. 6-8, the guide clip 104 is capable of receiving and retaining a pair of rebar pieces. The front edge periphery 188 of rectangular body 150 includes an upper front edge 162 associated with upper side 152, a lower front edge 164 associated with lower side 154, a right front edge 166 associated with right side 156, and a left front edge 168 associated with the left side 158. The opposing upper side 152 and lower side 154 of the clip body 150 are identical, so any reference to one applies equally to the other. Likewise, the opposing right side 156 and left side 158 of the clip body 150 are identical, so any reference to one applies equally to the other. The clip body 150 defines a void or interior space generally illustrated at 186. FIGS. 4-8 show an identical pair of individual guide clips 104.

Each side of the clip body 150 is slotted, in one form, with a keyhole-shaped notch, channel or cutout. In particular, each one of the upper side 152 and the lower side 154 is formed with a keyhole-shaped slot generally illustrated at 170, which keyhole-shaped slots 170 cooperate to facilitate the reception of a piece of rebar in a vertical orientation or alignment (FIGS. 6-7). Additionally, each one of the right side 156 and the left side 158 is formed with a keyhole-shaped slot generally illustrated at 190, which keyhole-shaped slots 190 cooperate to facilitate the reception of a piece of rebar in a horizontal orientation or alignment (FIG. 8). As discussed further in connection with FIG. 8, according to another exemplary embodiment of the present invention, the guide clip 104 simultaneously accommodates, holds, and retains a vertically-oriented rebar 20 (using the keyhole-shaped slots 170 formed in the upper and lower sides 152, 154) and a horizontally-oriented rebar 22 (using the keyhole-shaped slots 190 formed in the right and left sides 156, 158). In order to facilitate this tandem retention and hold on a pair of rebars 20 and 22, the keyhole-shaped slots 170,190 have different depths so that both rebars 20, 22 can fit together in the clip 104. In one form, for example, the keyhole-shaped slots 170 extends further than the keyhole-shaped slots 190, so that the final resting position of the vertical rebar 20 in keyhole-shaped slots 170 is deeper or further from the front edge periphery 188 than the final resting position of the horizontal rebar 22 in keyhole-shaped slots 190.

The keyhole-shaped slots 170 for upper side 152 and lower side 154 include, in combination, a slit-forming, elongate proximal section generally illustrated at 172 and an adjacent, adjoining circular distal section generally illustrated at 174. The proximal slit section 172 communicates with the distal circular section 174 to form a continuous slot. The proximal slit section 172 extends inward from the upper front edge 162 of upper side 152 and extends inward from the lower front edge 164 of lower side 154, creating respective openings 176 in the upper front edge 162 and the lower front edge 164. These openings 176 define a discontinuous or interrupted feature in the upper front edge 162 and the lower front edge 164. Formed in this way, each one of the upper side 152 and the lower side 154 of the clip body 150 features a slotted, split-design. The keyhole-shaped slots 170 terminate in the distal circular section 174. The width of the proximal slit section 172 is narrower than the diameter of the distal circular section 174. The keyhole-shaped slots 170 are considered blind slots, which as used herein encompasses a groove, slit, slot, notch, or channel that does not extend completely but only partially through the relevant side of the clip body 150. The distal circular section 174 has a semi-closed or open circle configuration. The proximal slit section 172 functions as a rebar-guiding feature to facilitate the guided displacement or translation of vertical rebar 20 through hollow clip body 150. The distal circular section 174 functions as the rebar-holding feature that receives the vertical rebar 20, following its translation through proximal slit section 172, and securely holds and retains the vertical rebar 20 in place. A vertically-extending passageway generally illustrated at 180 is defined by the pair of distal circular sections 174 associated with the keyhole-shaped slots 170 formed in upper side 152 and lower side 154. In its installed position in clip 104, the vertical rebar 20 coextends with this vertically-extending passageway 180.

The keyhole-shaped slots 190 formed in right side 156 and left side 158 of the clip body 150, which accommodate the horizontal rebar 22, are formed and configured in a manner similar to the keyhole-shaped slots 170 formed in the upper side 152 and the lower side 154, which receives the vertical rebar 20 (FIG. 8). Accordingly, the disclosures herein relating to the keyhole-shaped slots 170 apply equally to the keyhole-shaped slots 190. However, as discussed previously, one difference between the slotted features 170, 190 is the penetration depth or offset between the keyhole-shaped slot 170 and the keyhole-shaped slot 190 needed to permit the clip body 150 to receive, retain, and hold both the vertical rebar 20 and the horizontal rebar 22 at the same time (FIG. 8).

The illustrative keyhole-shaped slots 190 include, in combination, a slit-forming, elongate proximal section generally illustrated at 192 and an adjacent, adjoining circular distal section generally illustrated at 194. The proximal slit section 192 communicates with the distal circular section 194 to form a continuous slot. The proximal slit section 192 extends inward from the right front edge 166 of right side 156 and extends inward from the left front edge 168 of left side 158, creating respective openings 196 in right front edge 166 and left front edge 168. These openings 196 define a discontinuous or interrupted feature in the right front edge 166 and left front edge 168. Formed in this way, each one of the right side 156 and the left side 158 of the clip body 150 features a slotted, split-design. The distal circular section 194 of the keyhole-shaped slots 190 is similarly sized, shaped and dimensioned to the distal circular section 174 of keyhole-shaped slots 170, since both house, hold, retain, and otherwise accommodate a rebar of similar dimensions (cross-sectional area). However, the proximal slit section 192 of the keyhole-shaped slots 190 is shorter in length than the proximal slit section 172 of the keyhole-shaped slots 170, creating an offset or difference between the depth of onset of the distal circular section 174 of the keyhole-shaped slots 170 and the depth of onset of the distal circular section 194 of keyhole-shaped slots 190, wherein the depth refers to the length measured from the front peripheral edge 188. As a result, the distal circular section 174 of the keyhole-shaped slots 170 (retains the vertical rebar 20) is spaced further from the front peripheral edge 188 of the clip body 150 than the distal circular section 194 of the keyhole-shaped slots 190 (retains the horizontal rebar 22) is spaced from the front peripheral edge 188 of the clip body 150. This offset allows the clip body 150 to hold both the vertical rebar 20 and the horizontal rebar 22 simultaneously.

A vertically-extending passageway generally illustrated at 180 is defined by the pair of distal circular sections 174 associated with the keyhole-shaped slots 170 formed in the upper side 152 and the lower side 154. In its installed position in clip 104, the vertical rebar 20 coextends with this vertically-extending passageway 180 (FIGS. 7-8). A horizontally-extending passageway generally illustrated at 182 is defined by the pair of distal circular sections 194 associated with the keyhole-shaped slots 190 formed in right side 156 and left side 158. In its installed position in the clip 104, the horizontal rebar 22 coextends with this horizontally-extending passageway 182 (FIG. 8). The vertically-extending passageway 180 defines a first dimensional direction, while the horizontally-extending passageway 182 defines a second dimensional direction. The first dimensional direction and the second dimensional direction are oriented skew to one another.

Referring still to FIGS. 4 and 5, the front surface 122 of front clip-mounting side 120 of stabilization bracket 102 includes a clip-receiving slot, channel or recess generally illustrated at 128. The guide clip 104 includes a mounting base 184 on which the clip body 150 is disposed. The clip-receiving recess 128 and the mounting base 184 are cooperatively formed so that the mounting base 184 is slidably and securely positionable within clip-receiving recess 128. The combination of the mounting base 184 and the clip-receiving recess 128 can be provided in any suitable conventional form well known to those skilled in the art to facilitate a sliding-type mounting relationship. During assembly and final installation, in which the guide clip 104 is integrated with the mounted bracket 102, the guide clip 104 is removably mounted to the bracket 102 by slidably translating the mounting base 184 of the guide clip 104 within the clip-receiving recess 128 formed in front side 120 of the bracket 102 (FIG. 5). As shown, a pair of guide clips 104 are mounted to the bracket 102 to provide additional support and reinforcement to the retention of the vertical rebar 20 (FIGS. 6-7).

Referring now to FIGS. 6-7, with continuing reference to FIGS. 4-5, the installation of the vertical rebar 20 in assembly 100 is shown. In order to facilitate installation, the clip body 150 has a flexible, pliable, deformable, and/or resilient material construction. In particular, the clip body 150 has an elastic deformation property. The vertically-oriented rebar 20 is installed in each one of the pair of guide clips 104 in the same manner. The vertically-oriented rebar 20 is first aligned with the open front end 160 of the clip body 150 so that the length-wise body of the rebar 20 is orthogonal to the slotted upper side 152 and the slotted lower side 154 of the clip body 150. The rebar 20 is now advanced or moved forward into the keyhole-shaped slots 170 formed in the upper side 152 and the lower side 154, maintaining an orthogonal relationship to the keyhole-shaped slots 170. The rebar 20 first enters the proximal slit section 172 of the keyhole-shaped slots 170. The proximal slit section 172 serves as a guiding feature to direct and otherwise guide the translation or movement of the vertical rebar 20 to the terminus of the keyhole-shaped slits 170, the distal circular section 174. The width of the proximal slit section 172 is smaller than the diameter of the rebar 20. As a result, as the rebar 20 translates or displaces through the proximal slit section 172, the right side 156 and the left side 158 of the clip body 150 flex outwardly and yield in response to the larger-sized rebar 20 passing through the relatively smaller-sized proximal slit section 172, widening the clearance gap or opening of the proximal slot section 172 and spreading open the keyhole-shaped slots 170. The resilient, deformable construction of the clip body 150 allows the right side 156 and the left side 158 to spread apart, flex, and otherwise yield in response to the forcible movement of the rebar 20 through a relatively smaller-sized space (proximal slit section 172). The translation of the rebar 20 through the spread-apart, proximal slit section 172 continues until the rebar 20 reaches the distal circular section 174 of the keyhole-shaped slots 170, its terminal destination. Upon reaching the distal circular section 174, the vertically-oriented rebar 20 snaps into place within the space of the distal circular section 174. In navigating the keyhole-shaped slots 170, the rebar 20 travels through a path describing a vertical plane. Once the rebar 20 transitions from the proximal slit section 172 to the distal circular section 174, the right side 156 and the left side 158 of the clip body 150 flex back or return to their original resting state, due to the elastic deformation property of the clip body 150. Once the right side 156 and the left side 158 are restored to their original configuration, and the proximal slit section 172 resumes its original shape, the rebar 20 located in the keyhole-shaped slots 170 (at the circular distal section 174) experiences a compression-type hold applied by the symmetrical half sections of the keyhole-shaped slits 170. The distal circular section 174 may be sized smaller than the cross-sectional area of the rebar 20 by an amount adequate to promote a stabilizing, hold-type, frictional resistance that holds the rebar 20 in place. This frictional resistance occurs at the interface between the clip body 150 (at the circular distal section 174) and the external surface of the rebar 20. Another source of holding power on the rebar 20 is the clamping action that develops as the right side 156 and the left side 158 return to shape due to the elastic deformation property and apply a squeeze-type pressure against the rebar 20 located in the circular distal section 174.

In the configuration shown in FIGS. 6 and 7, with the rebar 20 installed in a pair of guide clips 104, the installed rebar 20 is held in place at four retention points, with each guide clip 104 contributing two points of retention. In each guide clip 104, the rebar 20 is secured by the keyhole-shaped slots 170 provided in the upper side 152 and the lower side 154 of the clip body 150. Although the rebar 20 is secured by a pair of guide clips 104, this illustration should not be considered in limitation of the present invention, as any number of guide clips 104 could be used depending on the application and how much holding strength is needed to support the vertical rebar 20 (i.e., one or more guide clips 104). The front side 120 of the bracket 102 can be readily adapted to accommodate a clip-receiving recess 128 of adequate size to fit the expected number guide clips 104 for slidable mounting in the recess 128. As shown in FIG. 7, the installation of the vertical rebar 20 in the pair of guide clips 104 leaves the vertical rebar 20 in a suspended position, supported entirely by the guide clips 104. In each clip 104, the installed vertical rebar 20 is held or stood in a vertical position by the clip body 150 at the top and bottom of the body 150 (i.e., the keyhole-shaped slots 170 in the upper side 152 and the lower side 154). The vertical rebar 20 may be of the type that includes a general J-hook shape at the bottom to provide a structure for linking or tying into a horizontal rebar laid in the footing trench. The installation arrangement shown in FIG. 7 finds particular benefit in concrete footing applications, where it is imperative to maintain the upright rebar in precise vertical alignment during the concrete pouring operation. The assembly 100 ensures that the vertically-oriented rebar 20 maintains its vertical positioning throughout the completion of the footing, but especially during the concrete fill operation. In one implementation, the fill level of the concrete is below the lowermost guide clip 104. Accordingly, once the footing is poured and the concrete solidifies, the assembly 100 can be removed in a process that is the reverse of the operations used to install the vertical rebar 20. For example, the bracket 102 can be released from its attachment to the temporary wood structure 10 by removing the fasteners from the fastener-receiving holes 140 and releasing the anchoring spikes 142 from their driven-in penetration into temporary wood structure 10. The released bracket 102 can be suitably maneuvered to release the guide clips 104 from their snap-in-place attachment to the rebar 20, i.e., the rebar 20 is backed out of the keyhole-shaped slot 170 in the opposite direction to that used to install the rebar 20.

Referring now to FIG. 8, the guide clip 104 can be employed to simultaneously secure the vertically-oriented rebar 20 and the horizontally-oriented rebar 22, according to a second exemplary embodiment of the present invention. Reference numerals which correspond to like elements of the apparatus described with respect to FIGS. 1-7 are designated by the same reference numerals in FIG. 8. The guide clip 104 receives the vertically-oriented rebar 20 in the same manner as described in relation to FIGS. 6 and 7 above. Moreover, the guide clip 104 receives the horizontally-oriented rebar 22 in a similar manner to how the vertically-oriented rebar 20 is installed. In particular, the horizontally-oriented rebar 22 is snapped into place within the keyhole-shaped slot 190 formed in the right side 156 and the left side 158 of clip body 150. The horizontally-oriented rebar 22 travels through the pair of keyhole-shaped slots 190 in the right and left sides 156, 158 on a pathway describing a horizontal plane. The rebar configuration shown in FIG. 8 can occur at an intersection or crossing junction 24 involving the vertically-oriented rebar 20 and the horizontally-oriented rebar 22. This rebar arrangement, for example, can be found at the bottom of a footing space where the horizontal rebar is laid and the vertical rebar is installed, which couples to the horizontal rebar. The use of the guide clip 104 to attach or couple the rebars 20, 22 is an alternate and improved approach to the tie-wire method used conventionally. The configuration shown in FIG. 8 can be used in combination with the arrangement shown in FIGS. 6 and 7.

The embodiment shown in FIG. 8 broadly discloses a clip 104 including a hollow rectangular body 150 having an open front end, an upper and lower side, and a right and left side.

The first keyhole-shaped slots 170 are formed in each of the upper and lower sides 152, 154 and extend from a front peripheral edge of the clip body 150 to a first depth. The second keyhole-shaped slots 190 are formed in each of the right and left sides 156, 158 and extend from the front peripheral edge of the clip body 150 to a second depth. The first depth (of the first keyhole-shaped slots 170) is greater than the second depth (of the second keyhole-shaped slots 190), creating an offset that allows the guide clip 104 to simultaneously hold, in tandem, a vertically-oriented rebar 20 in the pair of first keyhole-shaped slots 170 and a horizontally-oriented rebar 22 in the pair of second keyhole-shaped slots 190.

Referring again to FIGS. 1-7, the angled, stabilization bracket 102 can be fitted or otherwise equipped with an opening 118 formed in the top side 110. This portal or window 118 helps the installer to identify any alignment marks or indicia on the temporary support structure 10, which identify the locations for installing vertical rebar. The bracket 102 can be equipped with suitable markers or indicia to ensure that the installation of the bracket 102 can be properly coordinated with any external markers found on the temporary support structure 10. This coordination will ensure that the guide clips 104, when mounted to the front side 120 of the bracket 102, are properly positioned so that the pair of keyhole-shaped slots 170 (at the upper and lower sides 152, 154) will receive the vertical rebar 20 in such a manner that once the vertical rebar 20 snaps into place in the slots 170 at the distal circular sections 174, the vertical rebar 20 is properly aligned, both vertically and at the correct horizontal location within the footing space.

The guide clip 104 can be made of any suitable material capable of an elastic or reversible deformation. This material construction can include, but is not limited to, rubber, plastic, natural polymers, synthetic polymers, and resins.

Figure 15A:
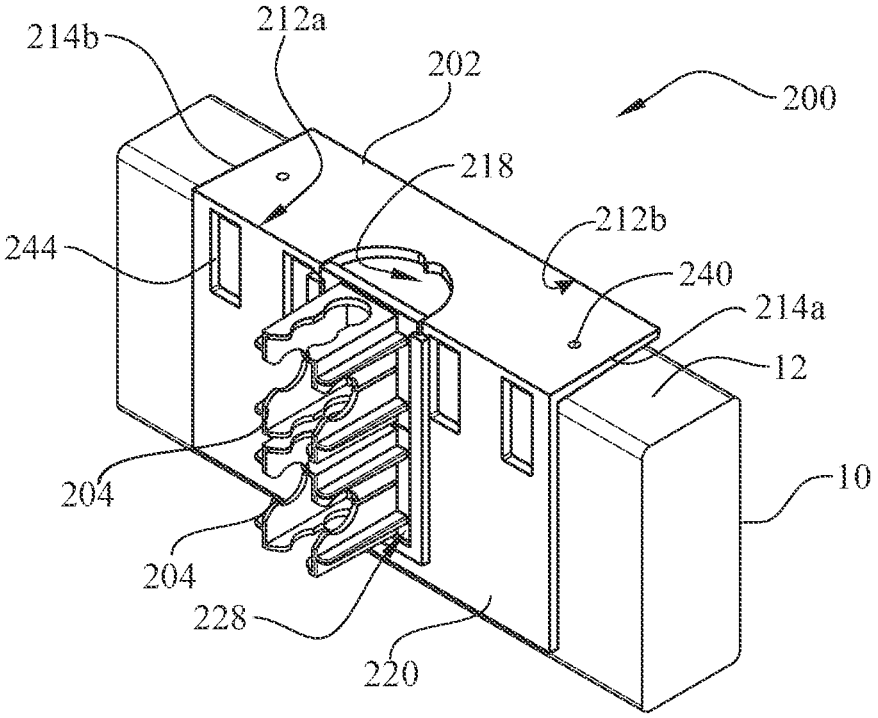
FIG. 15A presents a front, top isometric view of the template-mounted vertical rebar installation bracket illustrated in FIG. 9, further illustrating the mounted rebar-holding guide clips.
Figure 15B:
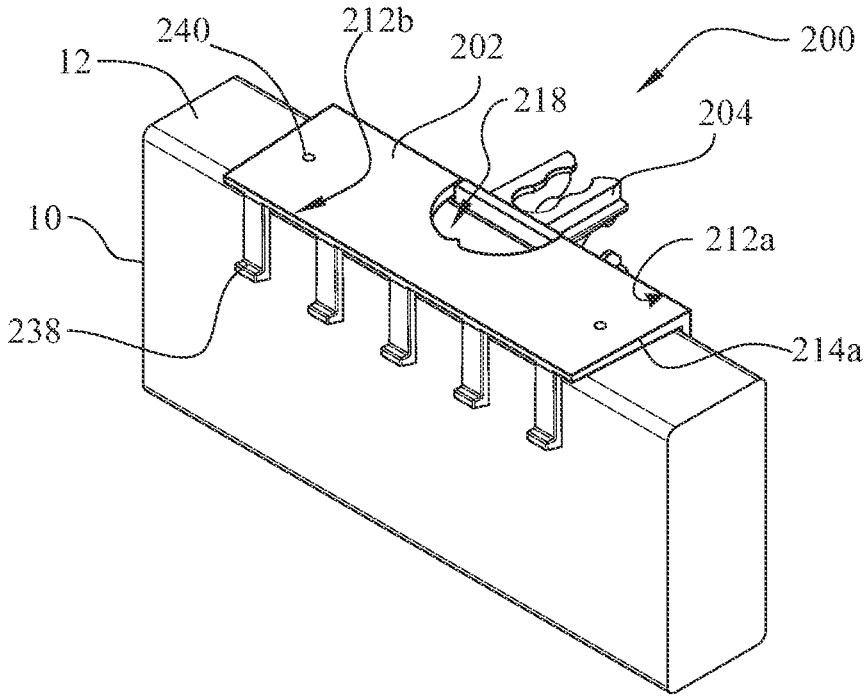
FIG. 15B presents a rear, top isometric view of the template-mounted vertical rebar installation bracket illustrated in FIG. 15A.
Figure 16:
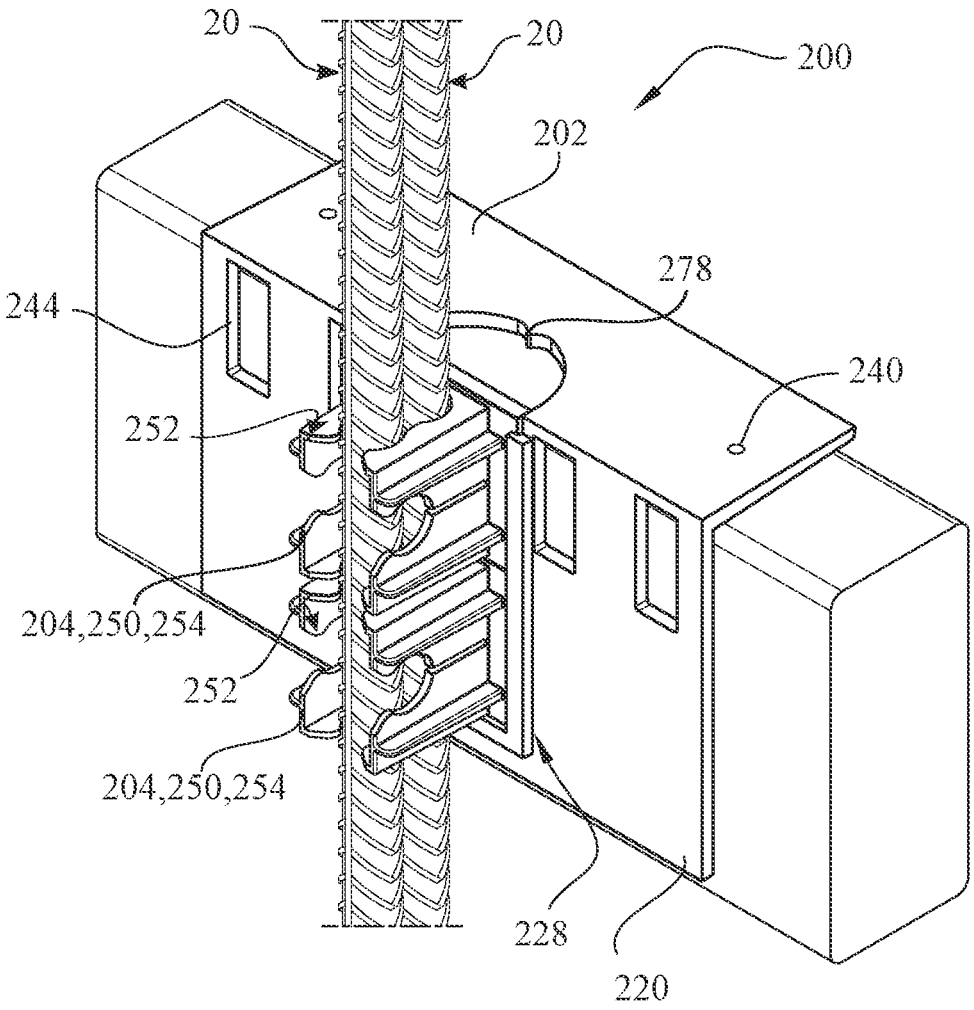
FIG. 16 presents a right side, front, top isometric view of the template-mounted vertical rebar installation bracket illustrated in FIG. 9, further illustrating the installation of the vertical rebars received in the guide channels defined in the mounted guide clips.
Figure 17:
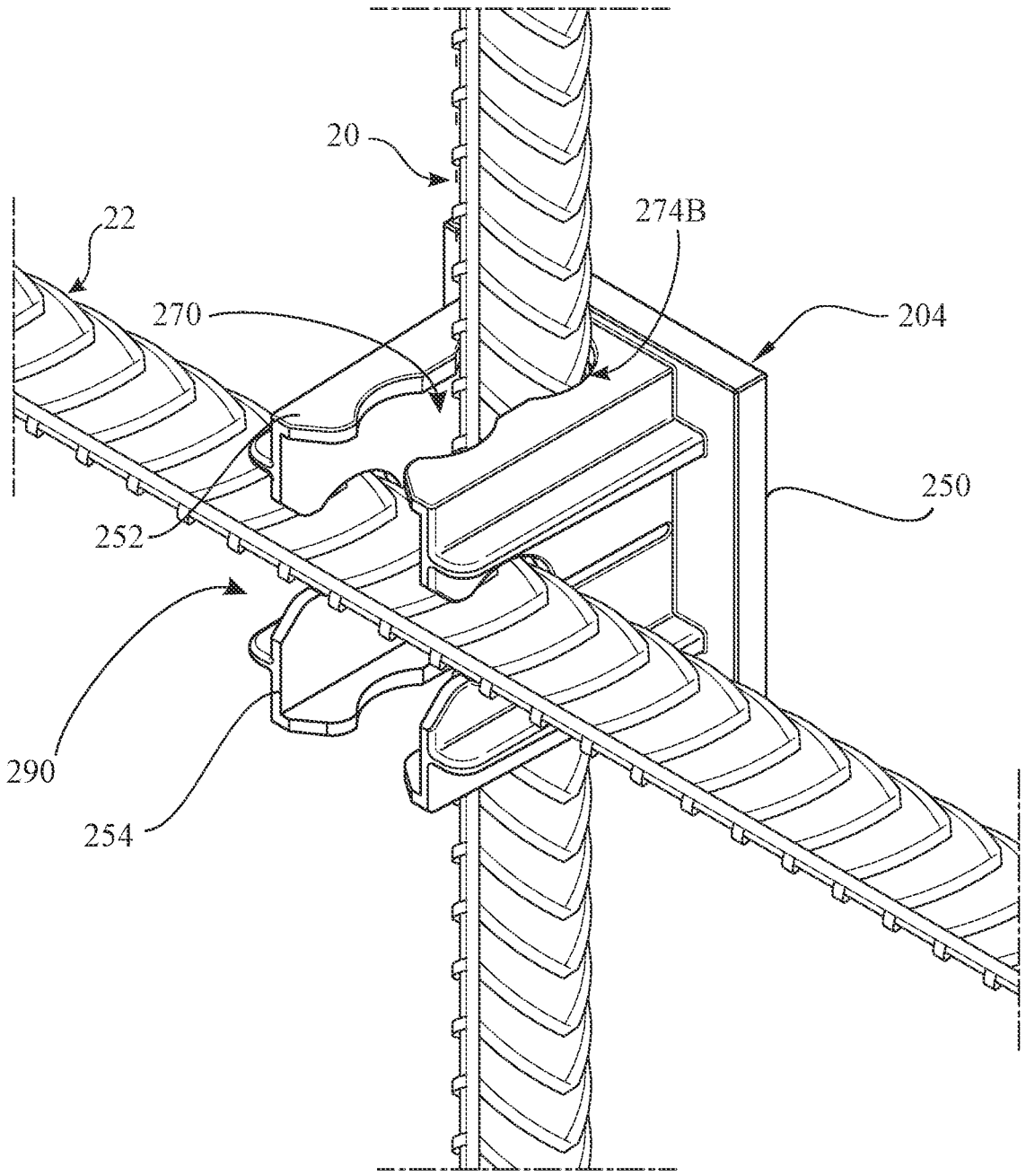
FIG. 17 presents an isometric view of a rebar-alignment and rebar-holding guide clip shown in FIGS. 11-16 and used in an alternative application to secure a crossing pair of vertical and horizontal rebar members at their intersection, according to a fourth illustrative embodiment of the present invention.

Referring next to FIGS. 9-17, a rebar installation assembly 200 is illustrated in accordance with a third exemplary embodiment of the present invention is shown at FIGS. 9-16, and a fourth exemplary embodiment is shown at FIG. 17. Reference numerals which correspond to like elements of the apparatus heretofore described with respect to FIGS.

1-8 are designated by the same reference numerals in the 200-299 series in FIGS. 9-17.

As shown in FIG. 16, the assembly 200 includes, in combination, a rebar installation and stabilization bracket 202 and at least one rebar-alignment and rebar-holding guide clip 204 that is removably mounted to bracket 202. During use, the bracket 202 is temporarily mounted to a conventional piece of timber 10 used in footing applications, such as a template or temporary wood backboard to mark locations for installing vertical rebar. The guide clip 204 is configured in one form as a vertical rebar holder and alignment tool. In particular, the mounted guide clip 204 receives at least one exemplary rebar 20 (also seen at FIG. 13) through a rebar-receiving slot and securely holds it in a properly aligned, vertical position. The assembly 200 ensures accurate placement or registration of vertical rebar, which is beneficial in construction environments or applications where vertically-arranged rebar is necessary for building a foundation and/or footing. The bracket 202 provides a stable platform to mount guide clip 204, and, in turn, the vertically-oriented rebar 20. The assembly 200 can be manufactured and made available as a kit of discrete components.

Figure 9:
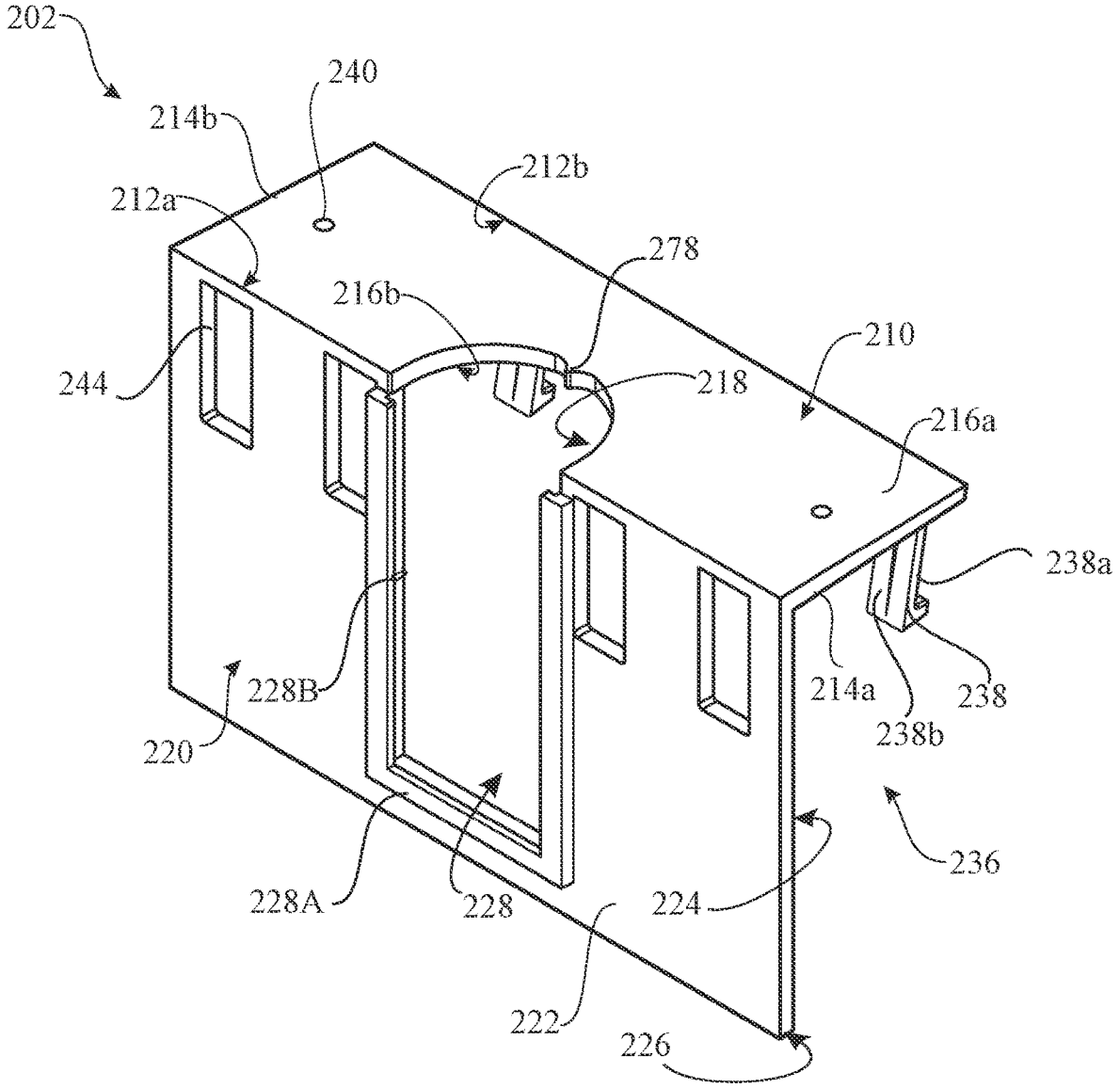
FIG. 9 presents a right side, front, top isometric view of a vertical rebar installation bracket, in accordance with a third illustrative embodiment of the present invention.
Figure 10A:
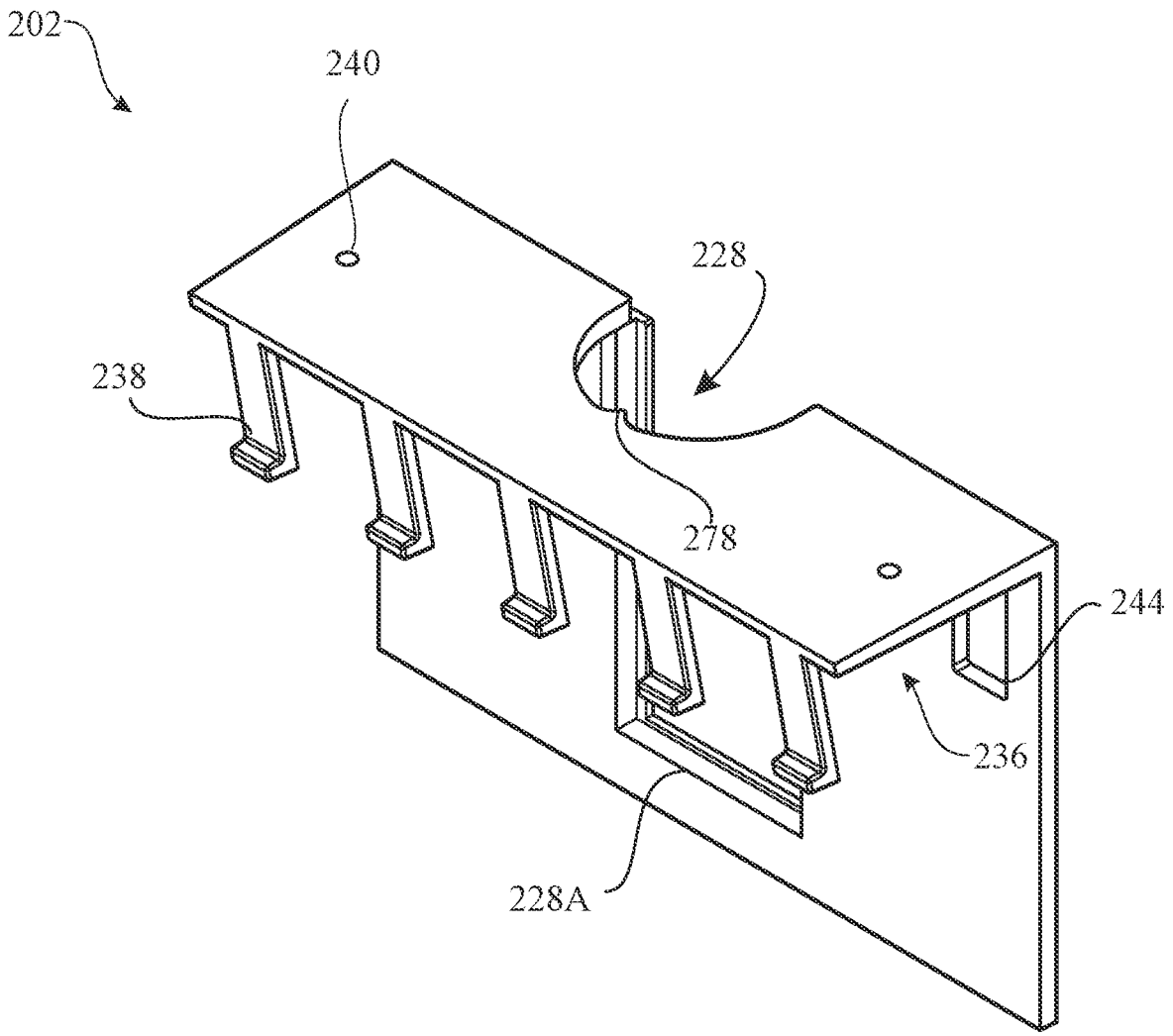
FIG. 10A presents a left side, rear, bottom isometric view of the vertical rebar installation bracket illustrated in FIG. 9.
Figure 10B:
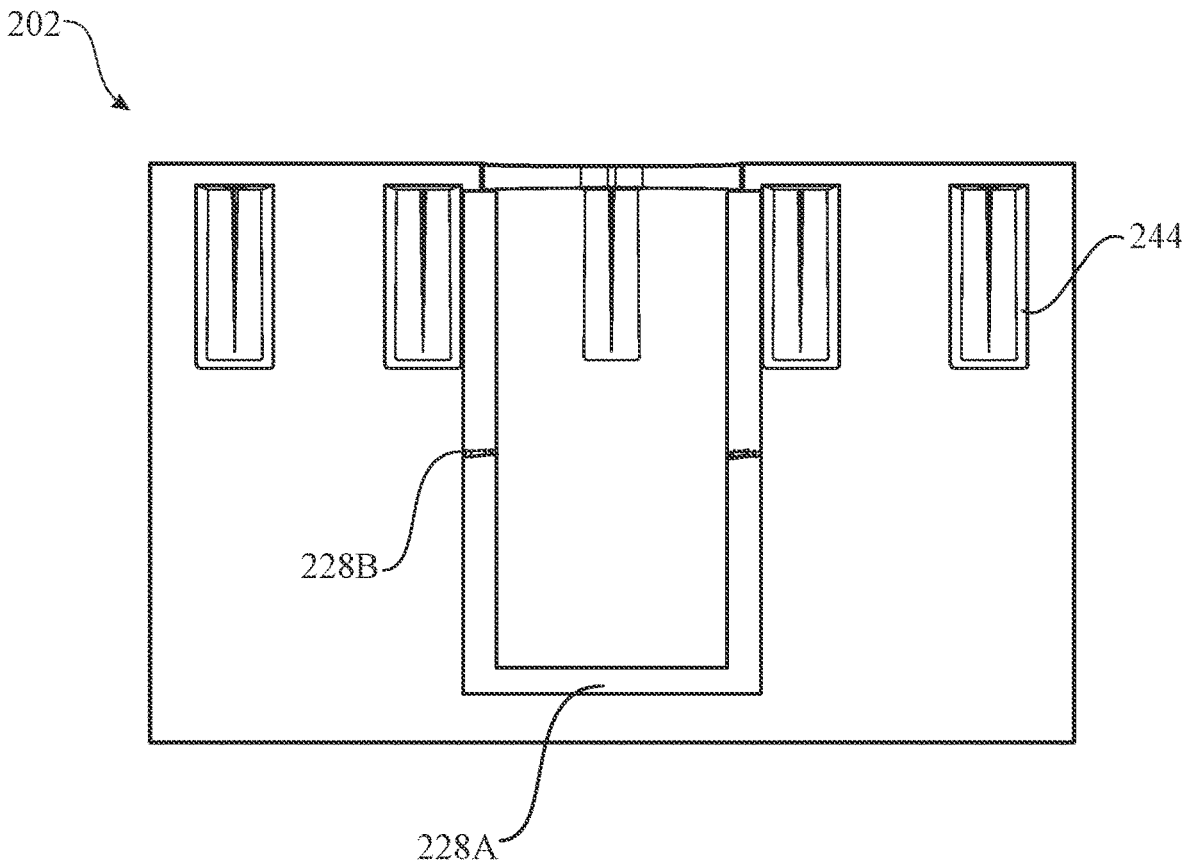
FIG. 10B presents a front view of the vertical rebar installation bracket illustrated in FIG. 9.
Figure 10C:
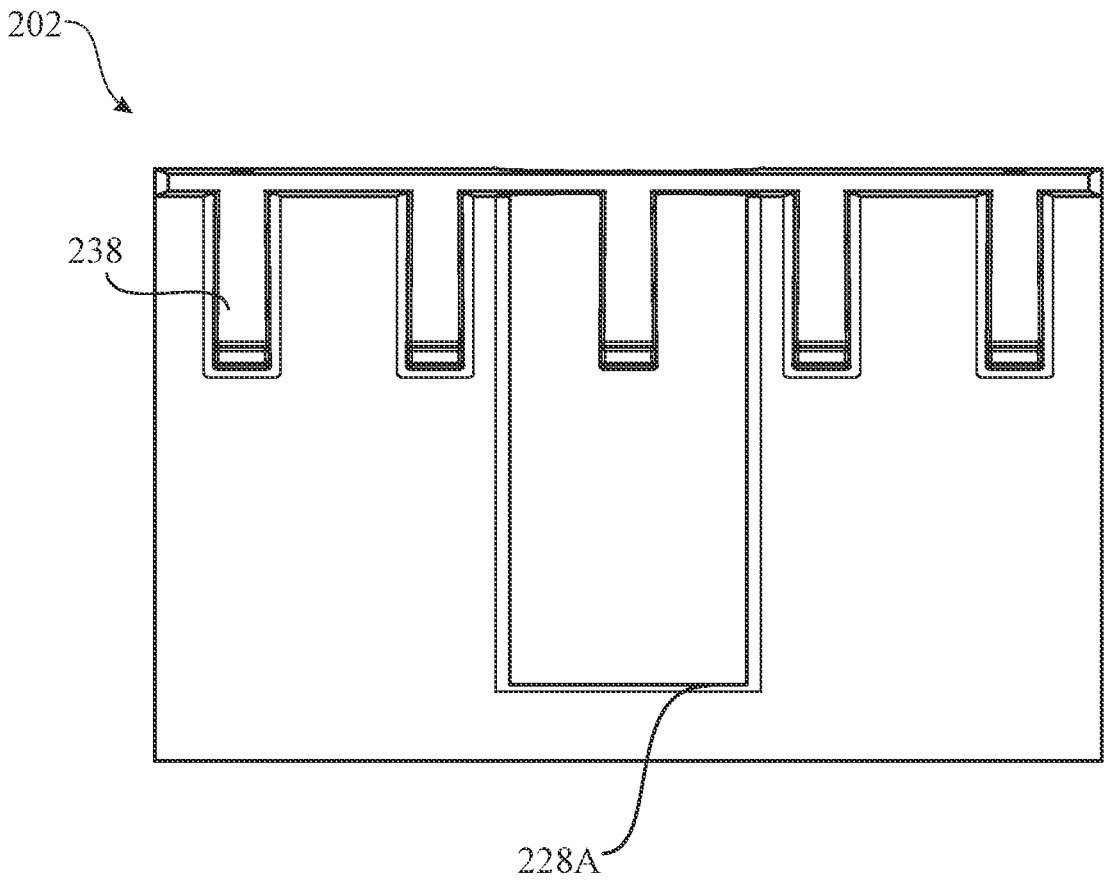
FIG. 10C presents a rear view of the vertical rebar installation bracket illustrated in FIG. 9.
Figure 10D:
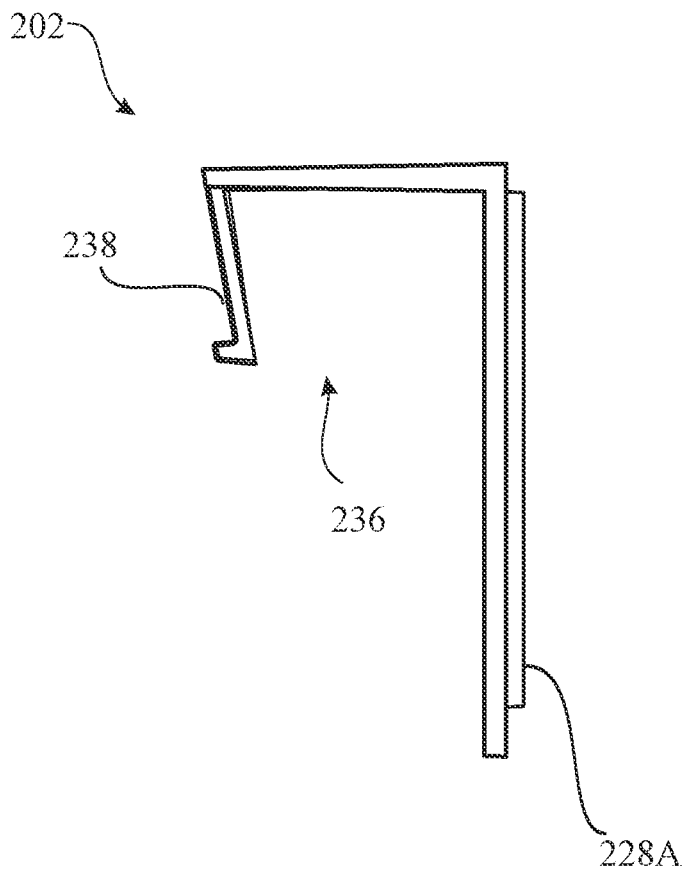
Figure 11:
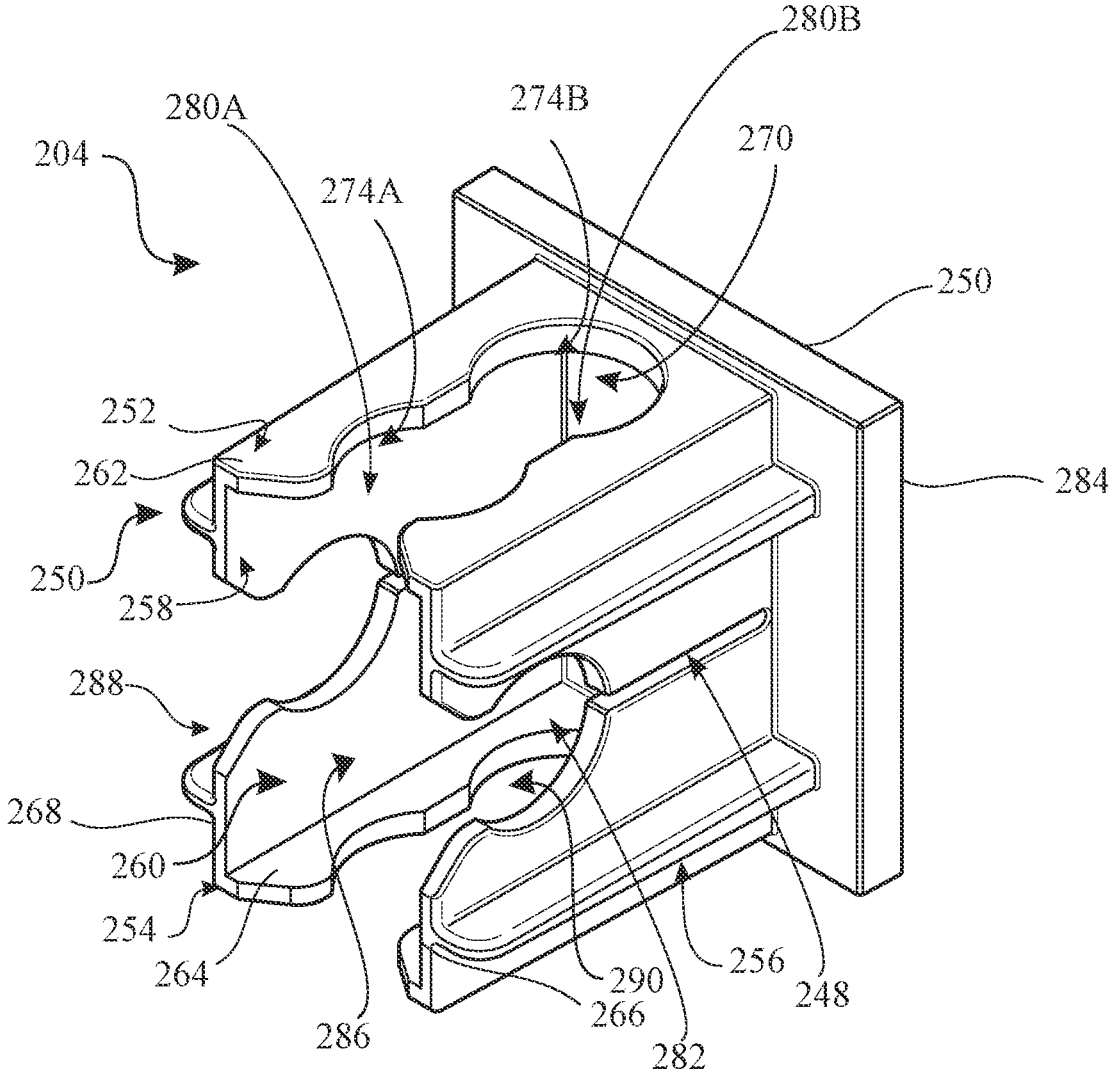
FIG. 11 presents a top, right perspective view of a rebar-holding guide clip in accordance with an embodiment of the present invention.
Figure 12A:
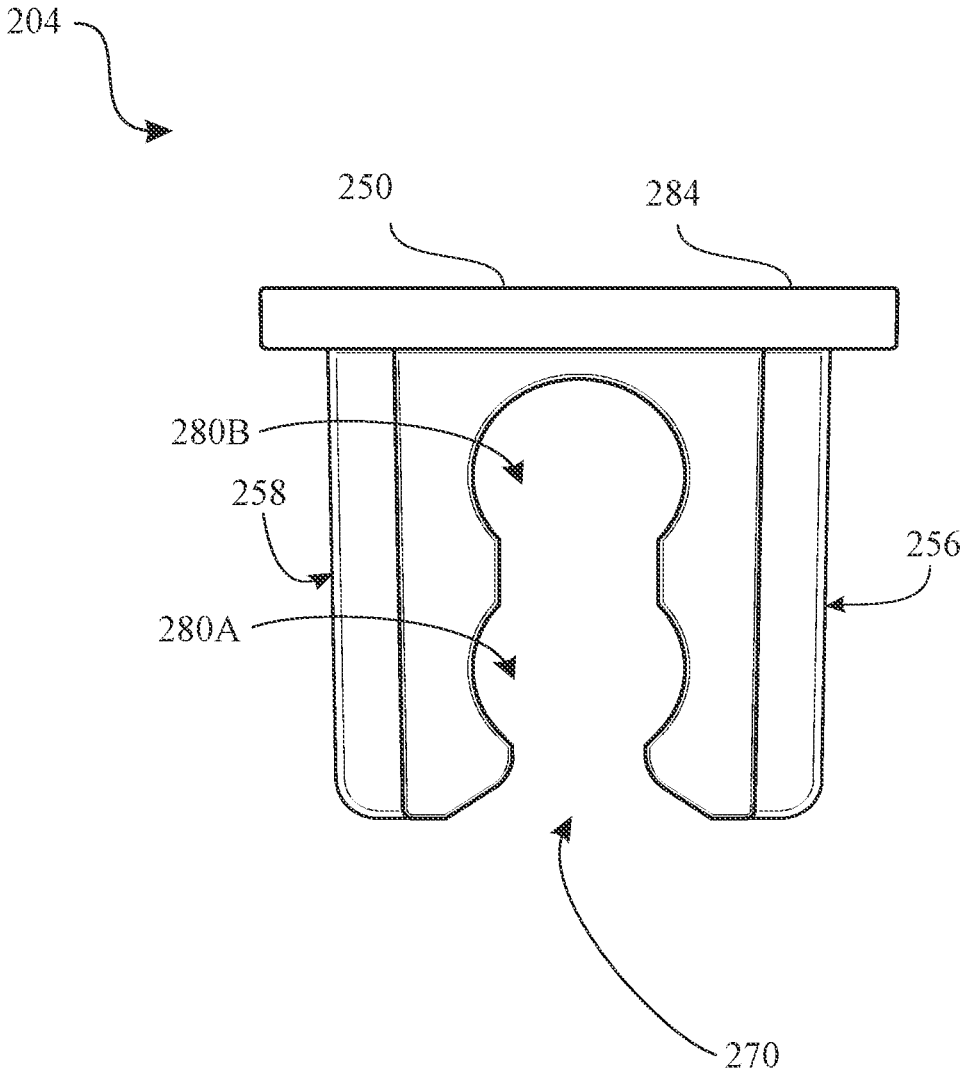
FIG. 12A presents a top view of a rebar-holding guide clip as in FIG. 11.
Figure 12B:
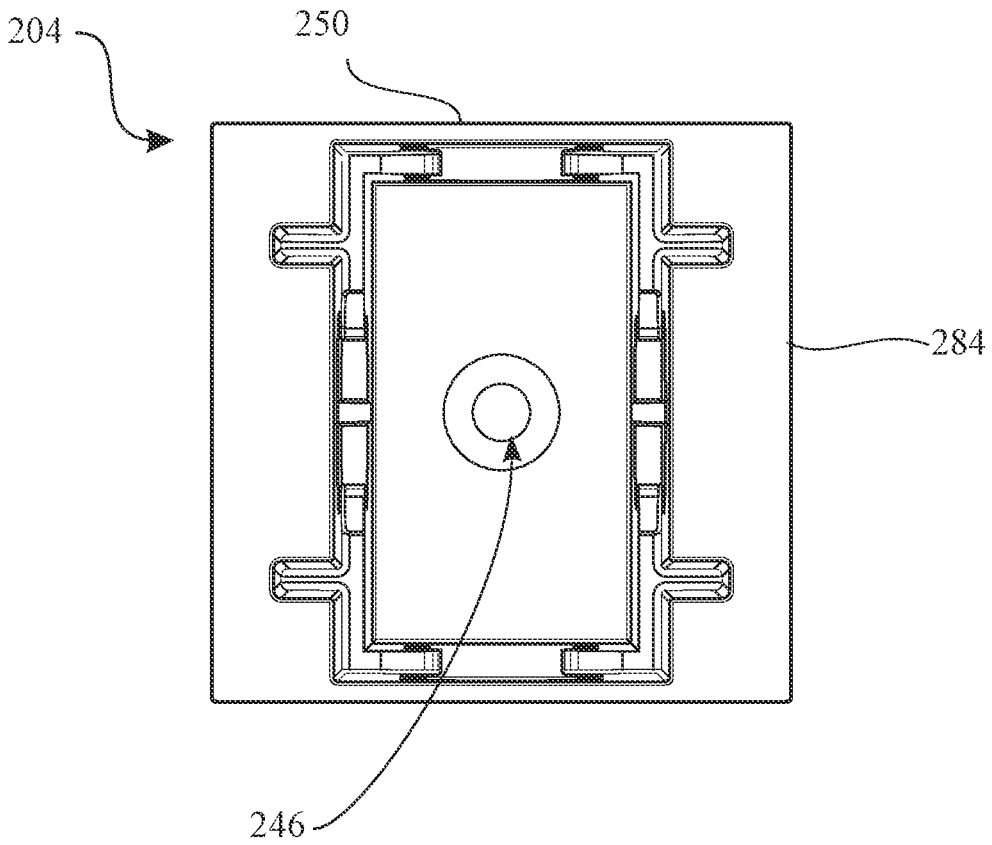
FIG. 12B presents a front view of a rebar-holding guide clip as in FIG. 11.
Figure 12C:
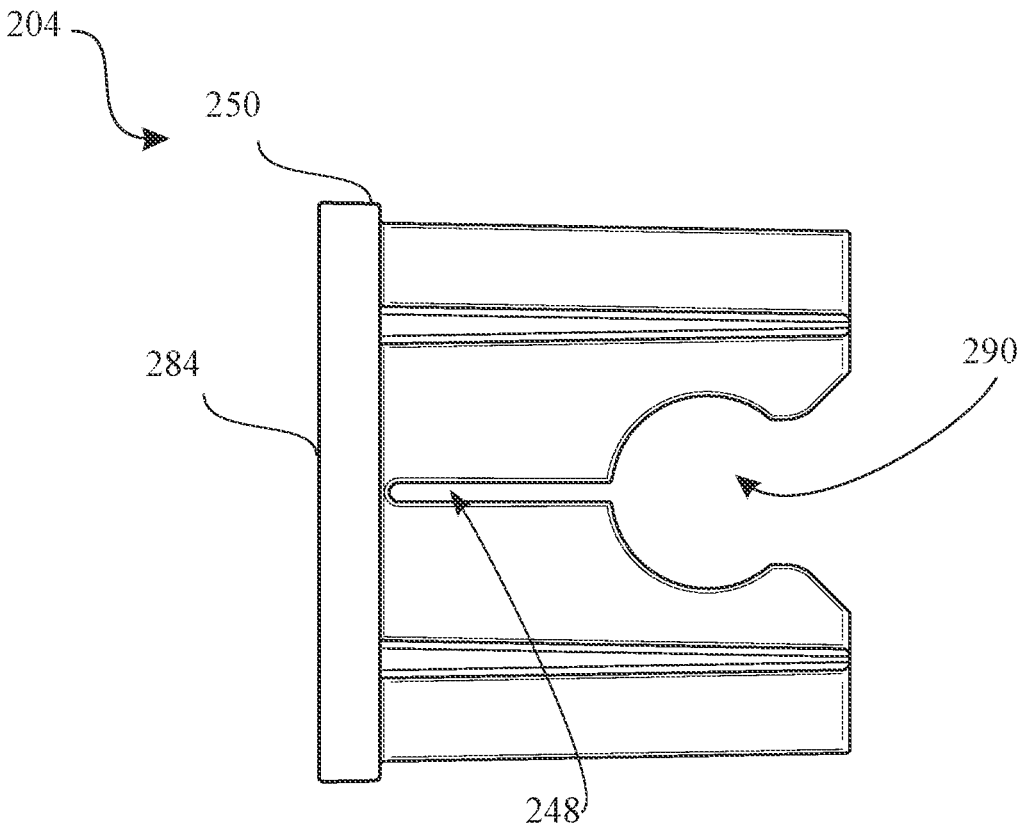
FIG. 12C presents a left side view of a rebar-holding clip as in FIG. 11, the right side view being a mirror image thereof.

Referring more particularly to FIG. 9, (also seen at FIGS. 10A-D, 15A-B and 16), the bracket 202 includes, in combination, a top side 210, a front clip-mounting side 220, and a plurality of rear downturned bracket anchoring teeth 238. In some embodiments the plurality of rear downturned bracket anchoring teeth comprises five evenly spaced rear downturned bracket anchoring teeth.

The front side 220 and intervening top side 210 of the bracket 202 each have a generally rectangular, planar form. The top side 210 includes front and rear longitudinal edges 212*a,b*, right and left lateral edges 214*a,b* extending between longitudinal edges 212*a,b*, upper surface 216*a*, and lower surface 216*b*. The front side 220 extends at an angle, preferably orthogonally, from the front longitudinal edge 212*a* of top side 202, forming an angled arrangement. The front side 220 includes a front or outer surface 222, a rear or inner surface 224, and bottom edge 226. The front side is provided with a plurality of bracket relief channels 244. In some embodiments, the plurality of bracket relief channels comprises four bracket relief channels. The plurality of bracket relief channels may comprise a first bracket relief channel, a second bracket relief channel, a third bracket relief channel and a fourth bracket relief channel. In some embodiments, the clip-receiving slot, channel, or recess 228 may be located between the second bracket relief channel and the third bracket relief channel.

The rear downturned bracket anchoring teeth 238 extend from the rear longitudinal edge 212*b* of top side 210, preferably in an orthogonal relationship. The front side 220 and the rear downturned anchoring teeth 238 form dependent features of the bracket 202, disposed in facing opposition to one another. The rear downturned anchoring teeth 238 include an outer portion 238*a* and an inner surface 238*b* disposed opposite and facing the inner surface 224 of front side 220. The front side 220 and the rear downturned anchoring teeth 238 define a template-receiving channel generally illustrated at 236, which forms the space extending between the inner surface 224 of front side 220 and the opposing inner surface 234 of rear downturned anchoring teeth 238. This channel 236 receives the temporary support 10 during deployment of assembly 200, in which bracket 202 is mounted to temporary support 10, as discussed further. The front side 220 can be configured as a plate-like structure.

During use, in reference to FIGS. 15A-B and 16, the bracket 202 is deployed in cooperation with the temporary support 10, such as a 2"×4" piece of lumber. As known, the construction of concrete footings requires a form to create the boundary space within which concrete is poured. The temporary support 10, for example, can be a section of this formwork or a lumber piece adapted to fit onto this framework. However implemented, the temporary support 10 facilitates the use of assembly 200 to properly locate, align, and place a vertical rebar at the required spot (e.g., within the footing space). In one form, for example, the temporary support 10 can span between the sidewalls of the formwork located at opposite sides of the footing trench. The temporary support 10, in this implementation, would extend crosswise or transversally across the footing trench space. Alternately, the temporary support 10 can be part of a footing template running the length-wise course of the footing trench. The temporary support 10 will typically be located at or above the upper surface or top level of the expected concrete pour.

The bracket 202, in one form, has the general shape of a flat or planar, J-shaped, hanging bracket hook, which, during deployment, adopts an inverted configuration. The front side 220 facilitates a secure attachment to a mounted article (i.e., temporary support 10), the rear downturned bracket anchoring teeth 238 function as a curb stop or break to constrain lateral movement of the mounted article, and top side 210 is seated on the mounted article. The temporary support 10, for example, has an upper surface 12 and a pair of side surfaces 14*a,b*. During installation, the bracket 202 is appropriately located and otherwise mounted on temporary support 10. In this mounting relationship, the top side 210 of bracket 202 is disposed on the upper surface 12 of temporary support 10, the front side 220 of bracket 202 is disposed in facing opposition to the first side surface 14*a* of temporary support 10, and the rear downturned bracket anchoring teeth 238 of bracket 202 are disposed in facing opposition to the second side surface 14*b* of temporary support 10. The temporary support 10, at an upper section, fits within and otherwise occupies the template-receiving channel formed between front side 220 and rear downturned bracket anchoring teeth 238 of the bracket 202. The size, shape, and dimensions of bracket 202 and temporary support 10 are appropriately coordinated so that bracket 202 will fit snugly over the temporary support 10. This snug fit preferably minimizes the clearance or gap space between the temporary support 10 (at sides 14*a,b*) and the front side 220 and rear downturned bracket anchoring teeth 238 of the bracket 202, and thereby restrain side-to-side relative movement between the bracket 202 and the temporary support 10.

The bracket 202 incorporates various features to secure the bracket 202 to the temporary support 10. The bracket 202 includes an array of individual fastener-receiving holes 240 distributed at various suitable locations of the bracket 202, features tailored to facilitating the temporary attachment of the bracket 202 to the mounted temporary support 10. Suitable conventional fasteners, such as screws or nails, are threaded through the fastener-receiving holes 240 to penetrate temporary support 10, securing the bracket 202 to the temporary support 10.

The combination of fastener-receiving holes 240 and the rear downturned bracket anchoring teeth 238 of the bracket 202 establish fastening features that securely hold together bracket 202 and the temporary support 10, inhibiting and otherwise resisting relative movement of these components in both the longitudinal (length-wise) and transverse (width-wise) directions. The capture of the temporary support 10 within the groove or channel 236 formed between the front side 220 and the rear downturned bracket anchoring teeth 238 of the bracket 202 helps control any relative lateral movement between the parts. The bracket 202 maintains a stable mounting relationship to temporary support 10.

The bracket 202 is also configured to provide a compression fit capable of sliding the bracket onto the temporary support 10 to speed up installation of the bracket 202 apparatus 200. The compression fit may enable a user to use the apparatus without using the nail holes 240 to nail the bracket 202 to the temporary support 10.

The bracket relief channels 244 also provide markings to enhance accuracy of placement of the bracket. In some embodiments, the bracket 202 may further include at least one center line mark 278 provided to enhance accuracy of placement and positioning of the bracket 202.

Optionally, the bracket 202 may also be provided with an array of individual anchoring spikes as shown and described herein with reference to the bracket 102.

Referring now to FIGS. 11, 12A-C and 13-14, with continuing reference to FIGS. 9-17, the guide clip 204 includes a hollow, generally rectangular body 250 having a spaced-apart and oppositely disposed upper side 252 and lower side 254, and a spaced-apart and oppositely disposed right side 256 and left side 258. Each side of body 250 has a generally planar formation and a rectangular shape. The guide clip body 250 has a front edge periphery 288 defining an open front end generally illustrated at 260, which facilitates the ingress and egress of a piece of rebar entering and exiting guide clip 204, respectively. As discussed further in connection with FIGS. 14-16, the guide clip 204 is capable of receiving and retaining a pair of rebar pieces. The front edge periphery 288 of rectangular body 250 includes an upper front edge 262 associated with upper side 252, a lower front edge 264 associated with lower side 254, right front edge 266 associated with right side 256, and left front edge 268 associated with left side 258. The opposing upper side 252 and lower side 254 of clip body 250 are identical, so any reference to one applies equally to the other. Likewise, the opposing right side 256 and left side 258 of clip body 250 are identical, so any reference to one applies equally to the other. The clip body 250 defines a void or interior space generally illustrated at 286. FIG. 16 shows an identical pair of individual guide clips 204.

Figure 13:
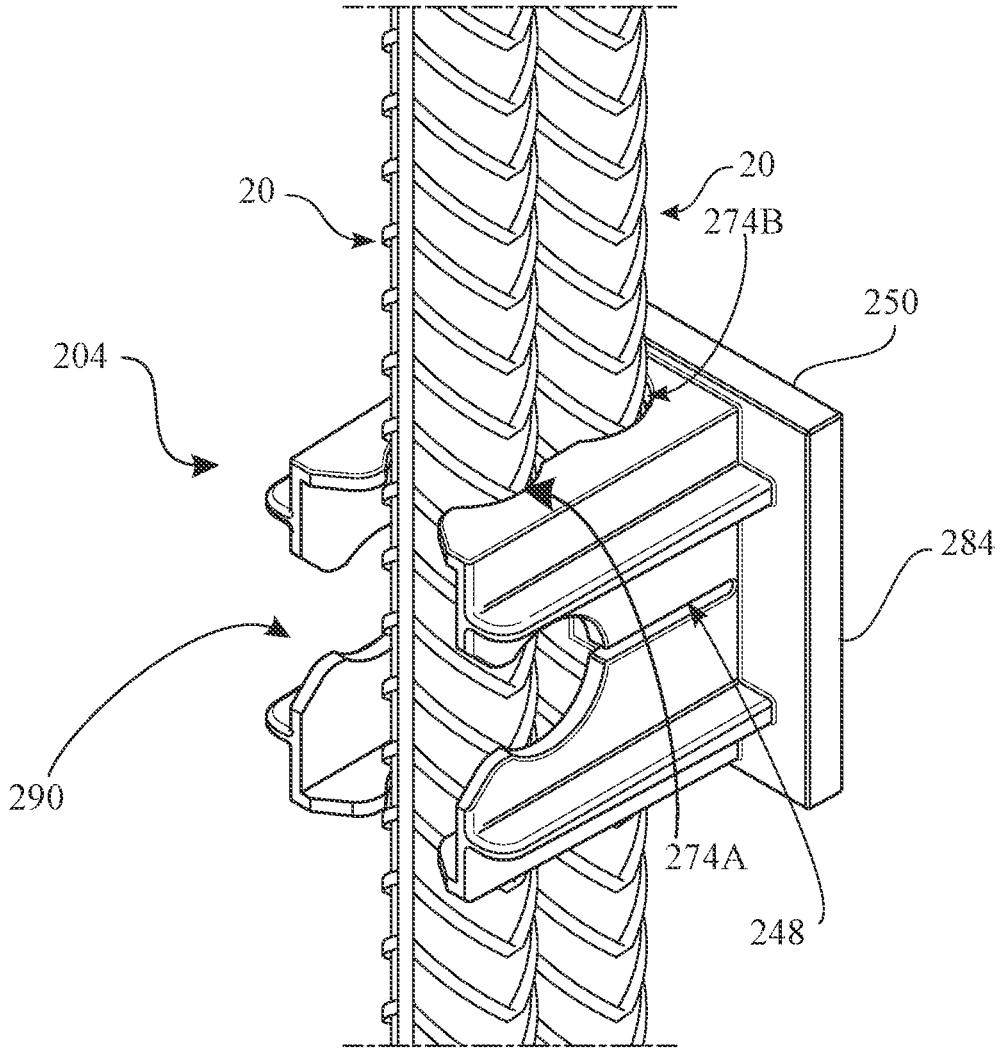
FIG. 13 presents a top, right perspective view of a rebar holding clip as in FIG. 11, with two vertical rebars installed therein.
Figure 14:
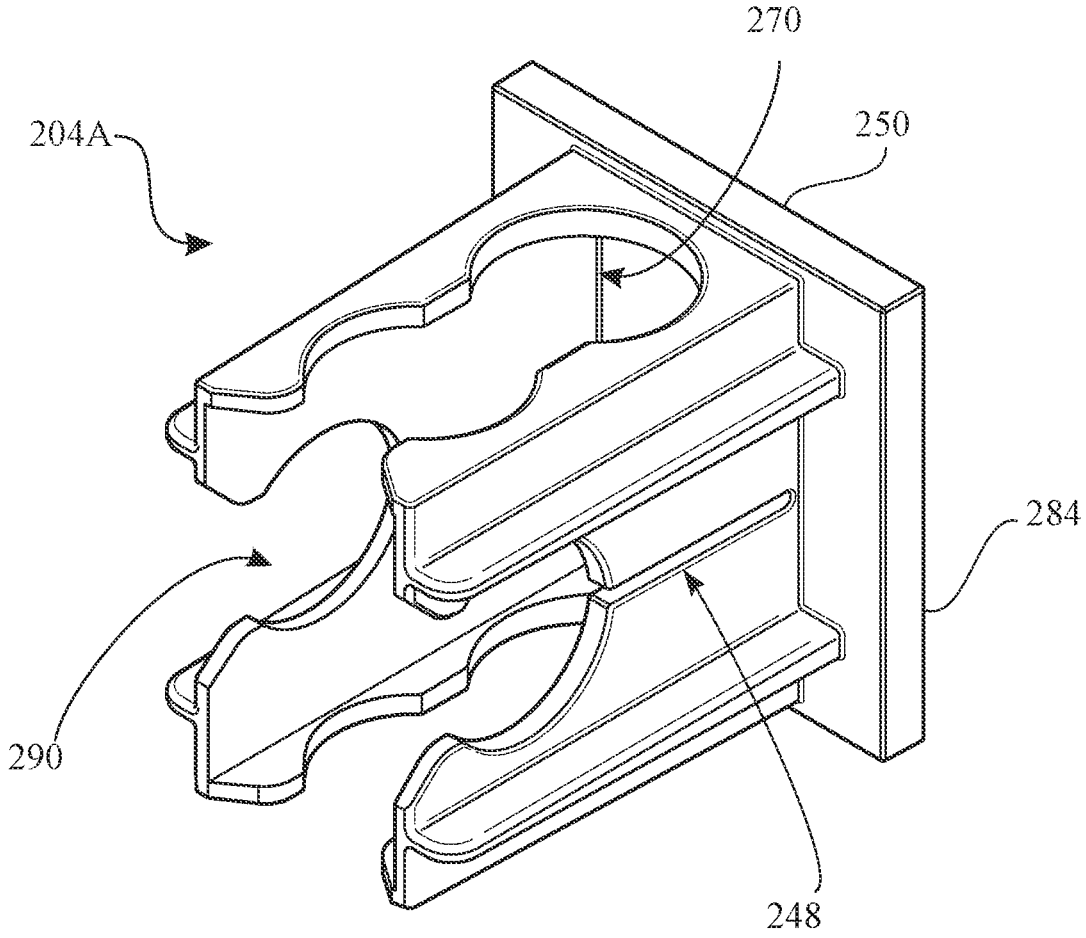
FIG. 14 presents a top, right perspective view of a rebar-holding guide clip in accordance with an embodiment of the present invention.

Each side of the clip body 250 is slotted, in one form, with a keyhole-shaped notch, channel or cutout. In particular, each one of upper side 252 and lower side 254 is formed with a keyhole-shaped slot generally illustrated at 270, which cooperate to facilitate the reception of a piece of rebar in a vertical orientation or alignment (FIG. 13 and FIG. 16). Additionally, each one of right side 256 and left side 258 is formed with a keyhole-shaped slot generally illustrated at 290, which cooperate to facilitate the reception of a piece of rebar in a horizontal orientation or alignment (FIG. 17).

As discussed further in connection with FIG. 17, according to another exemplary embodiment of the present invention, the guide clip 204 simultaneously accommodates, holds, and retains a vertically-oriented rebar 20 (using the keyhole-shaped slot 270 formed in the upper and lower sides 252, 254) and a horizontally-oriented rebar 22 (using the keyhole-shaped slot 290 formed in the right and left sides 256, 258). In order to facilitate this tandem retention and hold on a pair of rebars 20 and 22, the keyhole-shaped slots 270, 290 have different depths so that both rebars 20, 22 can fit together in clip 204. In one form, for example, the keyhole-shaped slot 270 extends further than the keyhole-shaped slot 290, so that the final resting position of the vertical rebar 20 in keyhole-shaped slot 270 is deeper or further from the front edge periphery 288 than the final resting position of the horizontal rebar 22 in keyhole-shaped slot 290.

The keyhole-shaped slot 270 for upper side 252 and lower side 254 includes, in combination, a proximal circular section generally illustrated at 274A, and an adjacent adjoining circular distal section generally illustrated at 274B. The proximal and distal circular sections 274A,274B communicate to form a continuous slot. The proximal circular section 272A extends inward from the upper front edge 262 of upper side 252 and extends inward from the lower front edge 264 of lower side 254, creating respective openings 276 in upper front edge 262 and lower front edge 264. These openings 276 define a discontinuous or interrupted feature in the upper front edge 262 and lower front edge 264. Formed in this way, each one of the upper side 252 and lower side 254 of clip body 250 features a slotted, split-design. The keyhole-shaped slot 270 terminates in the distal circular section 274B. The width of the proximal circular section 274A and the width of the distal circular section 274B are the same, and the proximal and distal circular sections are configured to accommodate a horizontal rebar 20. The slot 270 may be a keyhole-shaped slot and may be considered a blind slot, which as used herein encompasses a groove, slit, slot, notch, or channel that does not extend completely but only partially through the relevant side of the clip body 250. The distal circular section 274B has a semi-closed or open circle configuration. The proximal circular section 274A may function as a rebar-guiding feature to facilitate the guided displacement or translation of the vertical rebar 20 through the hollow clip body 250. The distal circular section 274B functions as the rebar-holding feature that receives the vertical rebar 20, following its translation through the proximal circular section 274A, and securely holds and retains the vertical rebar 20 in place.

The proximal circular section 274A may also function as a rebar-holding feature. A proximal vertically-extending passageway generally illustrated at 280A is defined by the pair of proximal circular sections 274A associated with the slots 270 formed in upper side 252 and lower side 254. In its installed position in clip 204, the vertical rebar 20 coextends with this vertically-extending passageway 280B.

The proximal circular section 274A may also function as a rebar-holding feature. A proximal vertically-extending passageway generally illustrated at 280A is defined by the pair of proximal circular sections 274A associated with the keyhole-shaped slots 270 formed in the upper side 252 and the lower side 254. In its installed position in clip 204, the vertical rebar 20 coextends with this vertically-extending passageway 280A.

The slot 290 formed in right side 256 and left side 258 of clip body 250, which accommodates a horizontal rebar 22, is formed and configured in a manner similar to the slot 270 formed in upper side 252 and lower side 254, which receives at least one vertical rebar 20. Accordingly, the disclosures herein relating to the slot 270 apply equally to the slot 290 configured to receive a horizontal rebar 22. However, as discussed previously, one difference between the slotted features 270, 290 is the penetration depth or offset between the slots 270, 290 needed to permit the clip body 250 to receive, retain, and hold both a vertical rebar 20 and a horizontal rebar 22 at the same time (FIG. 17). Further, the slot 290 may be configured and may function as shown and described with regard to the slot 190 described herein.

The circular section 294 of the horizontal slot 290 is similarly sized, shaped, and dimensioned to the distal circular section 274B of the vertical slot 270, since both house, hold, retain, and otherwise accommodate a rebar of similar dimensions (cross-sectional area). The vertical slot 270 configured to hold a vertical rebar 20 and the horizontal slot 190 configured to hold a horizontal rebar 22 may in some embodiments be configured to accommodate a vertical rebar 20 and a horizontal rebar that have different dimensions or diameters.

The clip 204 is configured to create or provide an offset or difference between the depth of onset of the distal circular section 274B of the vertical slot 270 and the depth of onset of the circular section 294 of the horizontal slot 290, wherein the depth refers to the length measured from the front peripheral edge 288. As a result, the distal circular section 274B of the vertical slot 270 (retains vertical rebar 20) is spaced further from the front peripheral edge 288 of clip body 250 than the circular section 294 of the horizontal slot 290 (retains horizontal rebar 22) is spaced from the front peripheral edge 288 of clip body 250. This offset allows clip body 250 to hold both vertical rebar 20 and horizontal rebar 22 simultaneously.

A vertically-extending passageway generally illustrated at 280 is defined by the pair of distal circular sections 274B associated with the vertical slots 270 formed in upper side 252 and lower side 254. In its installed position in clip 204, the vertical rebar 20 coextends with this vertically-extending passageway 280 (FIGS. 13 and 16-17). A horizontally-extending passageway generally illustrated at 282 is defined by the pair of circular sections 294 associated with the horizontal slots 290 formed in right side 256 and left side 258. In its installed position in the clip 204, the horizontal rebar 22 coextends with this horizontally-extending passageway 282 (FIG. 17). The vertically-extending passageway 280 defines a first dimensional direction, while the horizontally-extending passageway 282 defines a second dimensional direction. The first dimensional direction and the second dimensional direction are oriented skew to one another.

Referring to FIG. 9, the front surface 222 of front clip-mounting side 220 of stabilization bracket 202 includes a clip-receiving slot, channel or recess generally illustrated at 228. The clip-receiving slot 228 has a finished front opening 228A configured to slidingly receive at least one clip 204, and including a plurality of stops 228B configured to keep the at least one clip 204 in place.

The guide clip 204 includes a mounting base 284 on which the clip body 250 is disposed. The clip-receiving recess 228 and mounting base 284 are cooperatively formed so that mounting base 284 is slidably and securely positionable within clip-receiving recess 228. The combination of mounting base 284 and recess 228 can be provided in any suitable conventional form well known to those skilled in the art to facilitate a sliding-type mounting relationship. During assembly and final installation, in which guide clip 204 is integrated with the mounted bracket 202, the guide clip 204 is removably mounted to the bracket 202 by slidably translating the mounting base 284 of guide clip 204 within the clip-receiving recess 228 formed in front side 220 of bracket 202 (FIGS. 9 and 16). As shown, a pair of guide clips 204 are mounted to the bracket 202 to provide additional support and reinforcement to the retention of the vertical rebar 20 (FIG. 16).

The clip 204 may include at least one screw hole 246 provided at the mounting base 284 to receive a screw to affix the clip into a joist, or for secure placement by an installer of the clip into a joist or a water pipe or an electrical conduit. The clip may include one screw hole 246. The clip 204 may further include a plurality of relief cuts 248 configured to relieve expansion stress when installing the rebar. For example, at least one relief cut 248 may be provided at the right side 256 and left side 258 of the clip.

The installed vertical rebar 20 in assembly 200 is shown at FIG. 16. The installation of the vertical rebar 20 in the assembly 200 may be as described and with reference to the installation of the vertical rebar 20 in the assembly 100 at FIGS. 4-7 as described hereinabove. Further, a second vertical rebar 20 may also be installed in a same or similar manner.

In order to facilitate installation, the clip body 250 has a flexible, pliable, deformable, and/or resilient material construction. In particular, clip body 250 has an elastic deformation property. Each vertically-oriented rebar 20 is installed in each one of the pair of guide clips 204 in the same manner and held by a compression-type hold applied by the symmetrical half sections of the horizontal slip keyhole-shaped slit 270. The circular sections 274A,274B may be sized smaller than the cross-sectional area of each vertical rebar 20 by an amount adequate to promote a stabilizing, hold-type, frictional resistance that holds each vertical rebar 20 in place. This frictional resistance occurs at the interface between the clip body 250 and the external surface of rebar 20. Another source of holding power on rebar 20 is the clamping action that develops as the right side 256 and left side 258 return to shape due to the elastic deformation property and apply a squeeze-type pressure against the rebar 20 located in the circular sections 274A, 274B.

In the configuration shown in FIG. 16, with vertical rebars 20 installed in a pair of guide clips 204, the installed rebars 20 are held in place at four retention points, with each guide clip 204 contributing two points of retention. In each guide clip 204, the rebar 20 is secured by the vertical slot 270 provided in the upper side 252 and the lower side 254 of the clip body 250. Although the rebar 20 is secured by a pair of guide clips 204, this illustration should not be considered in limitation of the present invention, as any number of guide clips 204 could be used depending on the application and how much holding strength is needed to support the vertical rebar 20 (i.e., one or more guide clips 204). The front side 220 of the bracket 202 can be readily adapted to accommodate a clip-receiving recess 228 of adequate size to fit the expected number of guide clips 204 for slidable mounting in recess 228. As shown in FIG. 16, the installation of vertical rebars 20 in the pair of guide clips 204 leaves the vertical rebars 20 in a suspended position, supported entirely by the guide clips 204. In each clip 204, the installed vertical rebars 20 are held or stood in a vertical position by the clip body 250 at the top and the bottom of the body 250 (i.e., the vertical slots 270 in the upper side 252 and lower side 254). The vertical rebars 20 may be of the type that includes a general J-hook shape at the bottom to provide a structure for linking or tying into a horizontal rebar laid in the footing trench. The installation arrangement shown in FIG. 16 finds particular benefit in concrete footing applications, where it is imperative to maintain the upright rebar in precise vertical alignment during the concrete pouring operation. The assembly 200 ensures that the vertically-oriented rebar 20 maintains its vertical positioning throughout the completion of the footing, but especially during the concrete fill operation. In one implementation, the fill level of the concrete is below the lowermost guide clip 204. Accordingly, once the footing is poured and the concrete solidifies, the assembly 200 can be removed in a process that is the reverse of the operations used to install vertical rebar 20. For example, the bracket 202 can be released from its attachment to temporary wood structure 10 by removing the fasteners from fastener-receiving holes 240 and releasing the anchoring spikes 242 from their driven-in penetration into temporary wood structure 10. The released bracket 202 can be suitably maneuvered to release the guide clips 204 from their snap-in-place attachment to rebar 20, i.e., the rebar 20 is backed out of keyhole-shaped slot 270 in the opposite direction to that used to install rebar 20.

Referring now to FIG. 17, guide clip 204 can be employed to simultaneously secure the vertically-oriented rebar 20 and the horizontally-oriented rebar 22, according to a fourth exemplary embodiment of the present invention. Reference numerals which correspond to like elements of the apparatus described with respect to FIGS. 9-16 are designated by the same reference numerals in FIG. 17. The guide clip 204 receives the vertically-oriented rebar 20 in the same manner as described in relation to FIG. 16 above. Moreover, the guide clip 204 receives the horizontally-oriented rebar 22 in a similar manner to how the vertically-oriented rebar 20 is installed. In particular, the horizontally-oriented rebar 22 is snapped into place within the keyhole-shaped slot 290 formed in the right side 256 and the left side 258 of clip body 250. The horizontally-oriented rebar 22 travels through the pair of horizontal slots 290 in right and left sides 256, 258 on a pathway describing a horizontal plane. The rebar configuration shown in FIG. 17 can occur at an intersection or crossing junction 24 involving vertically-oriented rebar 20 and horizontally-oriented rebar 22. This rebar arrangement, for example, can be found at the bottom of a footing space where horizontal rebar is laid and vertical rebar is installed, which couples to the horizontal rebar. The use of guide clip 204 to attach or couple rebars 20, 22 is an alternate and improved approach to the tie-wire method used conventionally. The configuration shown in FIG. 17 can be used in combination with the arrangement shown in FIG. 16.

The embodiment shown in FIG. 17 broadly discloses a clip 204 including a hollow rectangular body 250 having an open front end, an upper and lower side, and a right and left side. A first vertical slot 270 is formed in each of the upper and lower sides 252, 254 and extends from a front peripheral edge of the clip body 250 to a first depth. A second horizontal slot 290 is formed in each of the right and left sides 256, 258 and extends from the front peripheral edge of the clip body 250 to a second depth. The first depth is greater than the second depth, creating an offset that allows the guide clip 204 to simultaneously hold, in tandem, a vertically-oriented rebar 20 in the horizontal slots 270 and a horizontally-oriented rebar 22 in the horizontal slots 290.

Referring again to FIGS. 9-16, the angled, stabilization bracket 202 can be fitted or otherwise equipped with an opening 218 formed in the top side 210. This portal or window 218 helps the installer to identify any alignment marks or indicia on the temporary support structure 10, which identify the locations for installing vertical rebar. The bracket 202 can be equipped with suitable markers or indicia to ensure that the installation of bracket 202 can be properly coordinated with any external markers found on temporary support structure 10. This coordination will ensure that guide clips 204, when mounted to front side 220 of bracket 202, are properly positioned so that the pair of horizontal slots 270 (at upper and lower sides 252, 254) will receive vertical rebar 20 in such a manner that once the vertical rebar 20 snaps into place in slots 270 at the distal circular sections 274B, the vertical rebar 20 is properly aligned, both vertically and at the correct horizontal location within the footing space.

The guide clip 204 can be made of any suitable material capable of an elastic or reversible deformation. This material construction can include, but is not limited to, rubber, plastic, natural polymers, synthetic polymers, and resins.

The apparatuses and the components thereof may be of any suitable size or dimensions as referred to herein.

For example, in some embodiments, a clip may be configured to accommodate a first and second parallel 0.50" diameter rebar, and a third 0.50" diameter rebar perpendicular to the first and second 0.50" diameter rebars. In other embodiments a clip may be configured to accommodate a first and second parallel 0.625" diameter rebar and a third 0.625" diameter rebar perpendicular to the first and second 0.625" diameter rebars. In other embodiments, a clip may be configured to accommodate at least one vertical rebar of any diameter and at least one horizontal rebar of any diameter. In some embodiments, the clip may have a length of up to about 1.50", a width of up to about 1.50", and a depth of up to about 1.70". In some embodiments, the clip may have a length of about 1.50", a width of about 1.50" and a depth of about 1.375". In some embodiments, the clip may have a length of about 1.50", a width of about 1.50" and a depth of about 1.625". Examples of clips having varied dimensions are shown at 204 of FIGS. 11 and 204A of FIG. 14.

The stabilization bracket of the apparatus may be configured to retain any number of clips as needed. In some embodiments, the stabilization bracket may be configured to removably hold up to two clips. The stabilization bracket and the clips may be removable and reusable. The stabilization bracket and its components may have any suitable dimensions. For example, in some embodiments, the bracket may have a width of between about 5.0-6.0" and a height of between about 3.0-4.0". The clip-receiving channel or recess may be configured to receive and retain multiple clips. In some embodiments, the clip-receiving channel or recess may have a width of between about 1.50"-1.60" and a height of between about 3.0"-3.25". The bracket relief channels may have a width of between about 0.40-0.50". The anchoring teeth may have a width of between about 0.25" and 0.50".

The apparatuses and components thereof as described herein may be used to install and secure building materials such as, for example without limitation, rebar, water pipe, electrical conduit, or the like.

The clip may be utilized in all phases of construction, as it may retain and stabilize any round, circular or tubular objects, such as, for example without limitation, rebar, plumbing water pipes, electrical EMT conduit, rebar, or any piping with a circular cross section. Nonlimiting examples of water pipes may include pipes made of Copper, PEX, PVC, CPVC, or the like. Nonlimiting examples of electrical conduit may include conduit made of PVC, EMT conduit, or the like. The clip is configured to be used on its own (without the stabilization bracket) in plumbing and electrical applications. The clip may be made in multiple sizes configured to accommodate a rebar, pipe, conduit or the like, sized from between about 0.50" diameter to about 1.25" diameter structures. For example without limitation the structure could have a diameter of 0.50", ⅝", 0.75" or the like.

Further, in some embodiments, the clip may be configured to accommodate a structure with any suitable cross section having any geometric shape (circular, square, hexagonal, or the like).

The clip may be configured to include horizontal and vertical slots which have an inner diameter (ID) that is the same diameter or cross-sectional dimensions as the outer diameter or outside dimension (OD) as the rebar, piping, or other object to be retained therein. For example without limitation, rebar or piping with an OD of ⅝" may be conveniently and securely held in a clip which has horizontal or vertical slots that have an ID of ⅝". As noted herein, the ID of the slots may be slightly smaller than the OD of the object to be secured.

The apparatus and its components, the stabilization bracket and the clips may be made by any suitable material and by any suitable fabrication process. Nonlimiting examples may include injection molding, additive manufacturing, 3D printing, or the like.

In one embodiment, a rebar installation assembly includes a bracket and a guide clip mounted to the bracket. The bracket has an angled construction including a top side, a front clip-mounting side, and a rear downturned lip portion. The bracket is mounted to a rectangular temporary structure in a construction environment, such as a footing area. The bracket is disposed on the temporary structure, such as a two-by-four piece of wood, so that the top side of the bracket faces the upper surface of the piece of wood, and the front side and the rear downturned lip portion of the bracket capture or sandwich the piece of wood between them. The guide clip includes a hollow rectangular body having an open front end, an upper and a lower side, and a right and a left side. A first keyhole-shaped slot is formed in each of the upper and lower sides and extends from the front peripheral edge of the clip body to a first depth. A second keyhole-shaped slot is formed in each of the right and left sides and extends from the front peripheral edge of the clip body to a second depth. The first depth is greater than the second depth, creating an offset that allows the guide clip to simultaneously hold, in tandem, a vertically-oriented rebar in the pair of first keyhole-shaped slots and a horizontally-oriented rebar in the pair of second keyhole-shaped slots.

In one embodiment, a rebar coupling apparatus and method enable easy effective aligning, stabilizing and secure fastening of a rebar assembly. The apparatus comprises at least one compression clip, at least one spike, and at least one J-hook. Optionally the apparatus may include a bracket. The rebar coupling apparatus method permits a user to snap the apparatus and its components in place to position, tightly fasten, and securely hold the rebar assembly and its elements in place. The user may apply a compression clip over vertical and horizontal rebars of the rebar assembly to align, position and stabilize the rebar assembly, and then install at least one spike to secure the alignment of the rebar assembly. Optionally, the user may then install a bracket over the rebar assembly. Once the vertical rebars are secured in place, the user may use the snap on J-hooks to hold the apparatus in place.

In one embodiment, the present invention provides an assembly for use in a construction environment, comprising an angled stabilization bracket and at least one clip removably mounted to the stabilization bracket. The angled stabilization bracket comprises a top portion having a first longitudinal edge and a second longitudinal edge opposing the first longitudinal edge, and a first side portion angularly extending from the first longitudinal edge; and a clip-receiving slot defined in the first side portion of the angled stabilization bracket. The at least one clip is slidably and removably disposed in the clip-receiving slot. The at least one clip further comprising at least one rebar-receivable and rebar-guiding passageway. The at least one clip is configured to receive and retain at least one rebar. The angled stabilization bracket is configured for attachment to a structure. The assembly is configured for use to ensure accurate placement or registration of vertical rebar in a construction environment.

In some embodiments, the structure comprises a piece of timber used in a construction footing application. The piece of timber may comprise a template or temporary wood backboard to which the stabilization bracket is temporarily mounted to mark at least one location for locations for installing the first vertical rebar.

In some embodiments, the at least one rebar-receivable and rebar-guiding passageway of the at least one clip comprises a first rebar-receivable and rebar-guiding passageway extending in a first direction; and a second rebar-receivable and rebar-guiding passageway extending in a second direction and oriented in one of orthogonal and skew to the first direction. In some embodiments, the at least one rebar-receivable and rebar-guiding passageway of the at least one clip further comprises a third rebar-receivable and rebar-guiding passageway extending in the first direction, parallel to the first rebar-receivable and rebar-guiding passageway.

In some embodiments, the at least one clip comprises a plurality of clips. In some embodiments, the at least one clip comprises a first clip and a second clip.

In some embodiments, the first clip and the second clip are removably disposed in the clip-receiving slot and disposed with the first rebar-receivable and rebar-guiding passageway of the first clip aligned with the first rebar-receivable and rebar-guiding passageway of the second clip, such that a first vertical rebar may be received by the first clip and the second clip and may extend through the first rebar-receivable and rebar-guiding passageway of the first clip and the first rebar-receivable and rebar-guiding passageway of the second clip.

In some embodiments, a second vertical rebar may be received by the first clip and the second clip, and may extend through the third rebar-receivable and rebar-guiding passageway of the first clip and the third rebar-receivable and rebar-guiding passageway of the second clip such that the second vertical rebar may be received by the first clip and the second clip and may extend through the third rebar-receivable and rebar-guiding passageway of the first clip and the third rebar-receivable and rebar-guiding passageway of the second clip, parallel to the first vertical rebar.

In some embodiments, a second vertical rebar may be received by the first clip, and may extend through the second rebar-receivable and rebar-guiding passageway extending in the second direction oriented in one of orthogonal and skew to the first direction. In some embodiments, the second direction is oriented orthogonally to the first direction. In other embodiments, the second direction is skewed with respect to the first direction.

In some embodiments the first clip and the second clip are configured to hold and align the first vertical rebar in a vertical position.

In some embodiments, the stabilization bracket further comprises a rear downturned lip angularly extending from the second longitudinal edge.

In other embodiments, the stabilization bracket further comprises a plurality of rear downturned bracket anchoring teeth angularly extending from the second longitudinal edge. The plurality of rear downturned bracket anchoring teeth may comprise five evenly spaced bracket anchoring teeth.

In some embodiments, the top portion is generally rectangular, and the first side portion comprises a generally rectangular front side portion. The front side includes a front outer surface, an inner surface, and a bottom edge.

In some embodiments, the front side may further comprise a plurality of bracket relief channels. The plurality of bracket relief channels may comprise four bracket relief channel further comprising a first bracket relief channel, a second bracket relief channel, a third bracket relief channel and a fourth bracket relief channel. The clip-receiving slot may be located between the second bracket relief channel and the third bracket relief channel.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An assembly for use in a construction environment, comprising:

an angled stabilization bracket comprising:

a top portion having a first longitudinal edge and a second longitudinal edge opposing the first longitudinal edge, and a first side portion angularly extending from the first longitudinal edge; and a clip-receiving slot defined in the first side portion of the angled stabilization bracket; and at least one clip removably mounted to the stabilization bracket, the at least one clip being slidably and removably disposed in the clip-receiving slot, the at least one clip further comprising at least one rebar-receivable and rebar-guiding passageway, wherein the at least one clip comprises a first clip and a second clip;

wherein the at least one rebar-receivable and rebar-guiding passageway of the at least one clip comprises:

a first rebar-receivable and rebar-guiding passageway extending in a first direction;

a second rebar-receivable and rebar-guiding passageway extending in a second direction and oriented in one of orthogonal and skew to the first direction; and a third rebar-receivable and rebar-guiding passageway extending in the first direction, parallel to the first rebar-receivable and rebar-guiding passageway:

wherein the at least one clip is configured to receive and retain at least one rebar;

wherein the angled stabilization bracket is configured for attachment to a structure;

wherein the assembly is configured for use to ensure accurate placement or registration of vertical rebar in a construction environment; and wherein the first clip and the second clip are removably disposed in the clip-receiving slot and disposed with the first rebar-receivable and rebar-guiding passageway of the first clip aligned with the first rebar-receivable and rebar-guiding passageway of the second clip, such that a first vertical rebar may be received by the first clip and the second clip and may extend through the first rebar-receivable and rebar-guiding passageway of the first clip and the first rebar-receivable and rebar-guiding passageway of the second clip.

2. The assembly of claim 1 wherein a second vertical rebar may be received by the first clip and the second clip, and may extend through the third rebar-receivable and rebar-guiding passageway of the first clip and the third rebar-receivable and rebar-guiding passageway of the second clip such that the second vertical rebar may be received by the first clip and the second clip and may extend through the third rebar-receivable and rebar-guiding passageway of the first clip and the third rebar-receivable and rebar-guiding passageway of the second clip, parallel to the first vertical rebar.

3. The assembly of claim 1 wherein a second vertical rebar may be received by the first clip, and may extend through the second rebar-receivable and rebar-guiding passageway extending in the second direction oriented in one of orthogonal and skew to the first direction.

4. The assembly of claim 3 wherein the second direction is oriented orthogonally to the first direction.

5. The assembly of claim 3 wherein the second direction is skewed with respect to the first direction.

6. The assembly of claim 1 wherein the structure comprises a piece of timber used in a construction footing application.

7. The assembly of claim 6 wherein the piece of timber comprises a template or temporary wood backboard to which the stabilization bracket is temporarily mounted to mark at least one location for locations for installing the first vertical rebar.

8. The assembly of claim 7, wherein the first clip and the second clip are configured to hold and align the first vertical rebar in a vertical position.

9. The assembly of claim 1 wherein the angled stabilization bracket further comprises a rear downturned lip angularly extending from the second longitudinal edge.

10. The assembly of claim 1 wherein the angled stabilization bracket further comprises a plurality of rear downturned bracket anchoring teeth angularly extending from the second longitudinal edge.

11. The assembly of claim 10 wherein the plurality of rear downturned bracket anchoring teeth comprises five evenly spaced bracket anchoring teeth configured to secure the stabilization bracket to the structure by a compression fit.

12. The assembly of claim 1 wherein the top portion is generally rectangular, and the first side portion comprises a generally rectangular front side portion.

13. The assembly of claim 12 wherein the front side portion includes a front outer surface, an inner surface, and a bottom edge.

14. An assembly for use in a construction environment, comprising:

an angled stabilization bracket comprising:

a top portion having a first longitudinal edge and a second longitudinal edge opposing the first longitudinal edge, and a first side portion angularly extending from the first longitudinal edge;

wherein the top portion is generally rectangular;

wherein the first side portion comprises a generally rectangular front side portion including a front outer surface, an inner surface, and a bottom edge; and wherein the front side portion further comprises a plurality of bracket relief channels; and a clip-receiving slot defined in the first side portion of the angled stabilization bracket; and at least one clip removably mounted to the stabilization bracket, the at least one clip being slidably and removably disposed in the clip-receiving slot, the at least one clip further comprising at least one rebar-receivable and rebar-guiding passageway;

wherein the at least one clip is configured to receive and retain at least one rebar;

wherein the angled stabilization bracket is configured for attachment to a structure; and wherein the assembly is configured for use to ensure accurate placement or registration of vertical rebar in a construction environment.

15. The assembly of claim 14 wherein the plurality of bracket relief channels comprises four bracket relief channels further comprising a first bracket relief channel, a second bracket relief channel, a third bracket relief channel and a fourth bracket relief channel; and wherein the clip-receiving slot is located between the second bracket relief channel and the third bracket relief channel.

* * * * *